US008676410B2

(12) United States Patent
Houpt et al.

(10) Patent No.: US 8,676,410 B2
(45) Date of Patent: Mar. 18, 2014

(54) SYSTEM AND METHOD FOR PACING A PLURALITY OF POWERED SYSTEMS TRAVELING ALONG A ROUTE

(75) Inventors: Paul Kenneth Houpt, Schenectady, NY (US); Joseph Forrest Noffsinger, Lees Summit, MO (US); Glenn Robert Shaffer, Erie, PA (US); James D. Brooks, Erie, PA (US)

(73) Assignee: General Electric Company, Schenectady, NY (US)

( * ) Notice: Subject to any disclaimer, the term of this patent is extended or adjusted under 35 U.S.C. 154(b) by 971 days.

(21) Appl. No.: 12/131,616

(22) Filed: Jun. 2, 2008

(65) Prior Publication Data

US 2009/0299555 A1 Dec. 3, 2009

(51) Int. Cl.
*G05D 1/00* (2006.01)

(52) U.S. Cl.
USPC ..... 701/19; 701/20; 701/96

(58) Field of Classification Search
USPC ..... 701/19, 20, 96
See application file for complete search history.

(56) References Cited

U.S. PATENT DOCUMENTS

| | | | | |
|---|---|---|---|---|
| 5,487,516 | A * | 1/1996 | Murata et al. | 246/182 C |
| 5,794,172 | A * | 8/1998 | Matheson et al. | 701/117 |
| 6,314,345 | B1 | 11/2001 | Coombes | |
| 6,332,107 | B1 * | 12/2001 | Gordon et al. | 701/20 |
| 6,401,015 | B1 | 6/2002 | Stewart et al. | |
| 6,435,624 | B1 | 8/2002 | Kull et al. | |
| 6,459,964 | B1 * | 10/2002 | Vu et al. | 701/19 |
| 6,680,918 | B1 | 1/2004 | Haley | |
| 6,789,004 | B2 | 9/2004 | Brousseau et al. | |
| 6,937,925 | B2 | 8/2005 | Smith | |
| 7,386,391 | B2 * | 6/2008 | Morariu et al. | 701/117 |
| 2007/0021968 | A1 | 1/2007 | Amir et al. | |
| 2007/0219681 | A1 | 9/2007 | Kumar et al. | |
| 2008/0033605 | A1 | 2/2008 | Daum et al. | |

FOREIGN PATENT DOCUMENTS

| | | | |
|---|---|---|---|
| EP | 1697196 | B1 | 12/2008 |
| RU | 2237589 | C1 | 10/2004 |
| RU | 2238860 | C1 | 10/2004 |
| WO | 2004059446 | A2 | 7/2004 |

OTHER PUBLICATIONS

International Search Report issued in connection with corresponding PCT Application No. PCT/US2009/045956 on Oct. 23, 2009.
Written Opinion issued in connection with corresponding PCT Application No. PCT/US2009/045956 on Oct. 23, 2009.
Search Report from Eurasian Application No. 201001725 dated Aug. 4, 2011.

* cited by examiner

*Primary Examiner* — S. Joseph Morano
*Assistant Examiner* — Zachary Kuhfuss
(74) *Attorney, Agent, or Firm* — General Electric Company; John A. Kramer

(57) ABSTRACT

A system is provided for pacing a plurality of powered systems traveling along a route. The plurality of powered systems include a constraining powered system and at least one trailing powered system traveling behind the constraining powered system along the route. The system includes one or more controllers configured to control the constraining powered system to travel along the route according to respective predetermined operating parameters at respective incremental locations along the route. The system further includes one of said controllers being configured to control the trailing powered system to travel along the route according to the respective predetermined operating parameters of the constraining powered system at the respective incremental locations along the route. A method is also provided for pacing a plurality of powered systems traveling along the route.

10 Claims, 18 Drawing Sheets

SYSTEM AND METHOD FOR PACING A PLURALITY OF POWERED SYSTEMS TRAVELING ALONG A ROUTE

BACKGROUND OF THE INVENTION

This invention relates to a powered system, such as a train, an off-highway vehicle, a marine vessel, a transport vehicle, and/or an agriculture vehicle and, more particularly, to a system and method for pacing a plurality of powered systems traveling along a route.

Some powered systems such as, but not limited to, off-highway and highway vehicles, marine propulsion plants, stationary powered systems, transport vehicles such as transport buses, agricultural vehicles, and rail vehicle systems or trains, are powered by one or more diesel power units, diesel-fueled power generating units, or electric power units drawing energy from overhead or lateral power sources. With respect to rail vehicle systems, a diesel power unit is usually a part of at least one locomotive powered by at least one diesel internal combustion engine and the train further includes a plurality of rail cars, such as freight cars. Usually more than one locomotive is provided, wherein the locomotives are referred to as a locomotive consist. Locomotives are complex systems with numerous subsystems, with each subsystem being interdependent on other subsystems.

Rail vehicles, such as locomotives, for example, are constrained to travel along a railroad track, which is typically divided into a number of block regions to prevent collisions. Each block region may include a signal light without a switch or a switch and a light signal positioned adjacent to the switch. When a locomotive occupies a block region, the light signal in the previous block region will have a red status, and the next upstream region will have a yellow status, requiring the operator of a locomotive in the yellow block region to stop before entering the red region. The light signal in the third previous block region will have a green status, without any necessity to slow or stop the locomotive occupying that block region, and thus a locomotive which maintains a minimum two block region separation from a leading locomotive will achieve an ideal "constant green" signal status. Although an operator of a locomotive will strive to maintain a minimum two block region separation and the "constant green" signal status, since the operator is not typically equipped with necessary speed information about the train ahead, the locomotive will inevitably fluctuate between yellow, red and green status block regions throughout a trip, thereby requiring slowing down and speeding up of the locomotive, resulting in excess fuel usage from the braking and acceleration of the locomotive versus maintaining steady speed.

Thus, it would be advantageous to provide a system which provides the operator (or automatic controller) of the locomotive with the necessary information to maintain a minimum two block region separation from the leading locomotive, so to maintain the "constant green" signal status, and thereby maximize the efficient operation of the locomotive. With multiple trains traversing a given territory or a region within the territory, it would be advantageous to provide for coordination among all of the trains, to assist in the smooth and efficient flow of trains with a minimum of accelerations and slowdowns along the route.

BRIEF DESCRIPTION OF THE INVENTION

One embodiment of the present invention provides a system for pacing a plurality of powered systems traveling along a route. The plurality of powered systems include a constraining powered system and at least one trailing powered system traveling behind the constraining powered system along the route. The system includes one or more controllers configured to control the constraining powered system to travel along the route according to respective predetermined operating parameters at respective incremental locations along the route. The system further includes one of said controllers being configured to control the trailing powered system to travel along the route according to the respective predetermined operating parameters of the constraining powered system at the respective incremental locations along the route.

Another embodiment of the present invention provides a system for pacing a plurality of powered systems traveling along a route. The system includes the plurality of powered systems traveling along the route with a common operating parameter at a respective incremental location over a pacing region along the route. The plurality of powered systems maintain at least one of a minimum spacing variation and a minimum velocity variation over the pacing region.

Another embodiment of the present invention provides a method for pacing a plurality of powered systems traveling along a route. The plurality of powered systems include a constraining powered system and at least one trailing powered system traveling behind the constraining powered system along the route. The method includes determining a respective plan including an operating parameter of the constraining powered system and at least one trailing powered system at incremental locations along the route. The method further includes modifying the respective plan of the at least one trailing powered system based on the respective plan of the constraining powered system. The method further includes enforcing the respective plan of the constraining powered system and the modified plan of the at least one trailing powered system at incremental locations along the route so to maintain at least a threshold separation between the constraining powered system and the at least one trailing powered system.

Another embodiment of the present invention provides a method for pacing a plurality of powered systems traveling along a route. The plurality of powered systems include a constraining powered system and at least one trailing powered system traveling behind the constraining powered system along the route. The method includes controlling the constraining powered system to travel along the route according to respective predetermined operating parameters at respective incremental locations along the route. The method further includes controlling the trailing powered system to travel along the route according to the respective predetermined operating parameters of the constraining powered system at the respective incremental locations along the route.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, exemplary embodiments of the invention will be described and explained with additional specificity and detail through the use of the accompanying drawings in which.

DETAILED DESCRIPTION OF THE INVENTION

Figure 1:
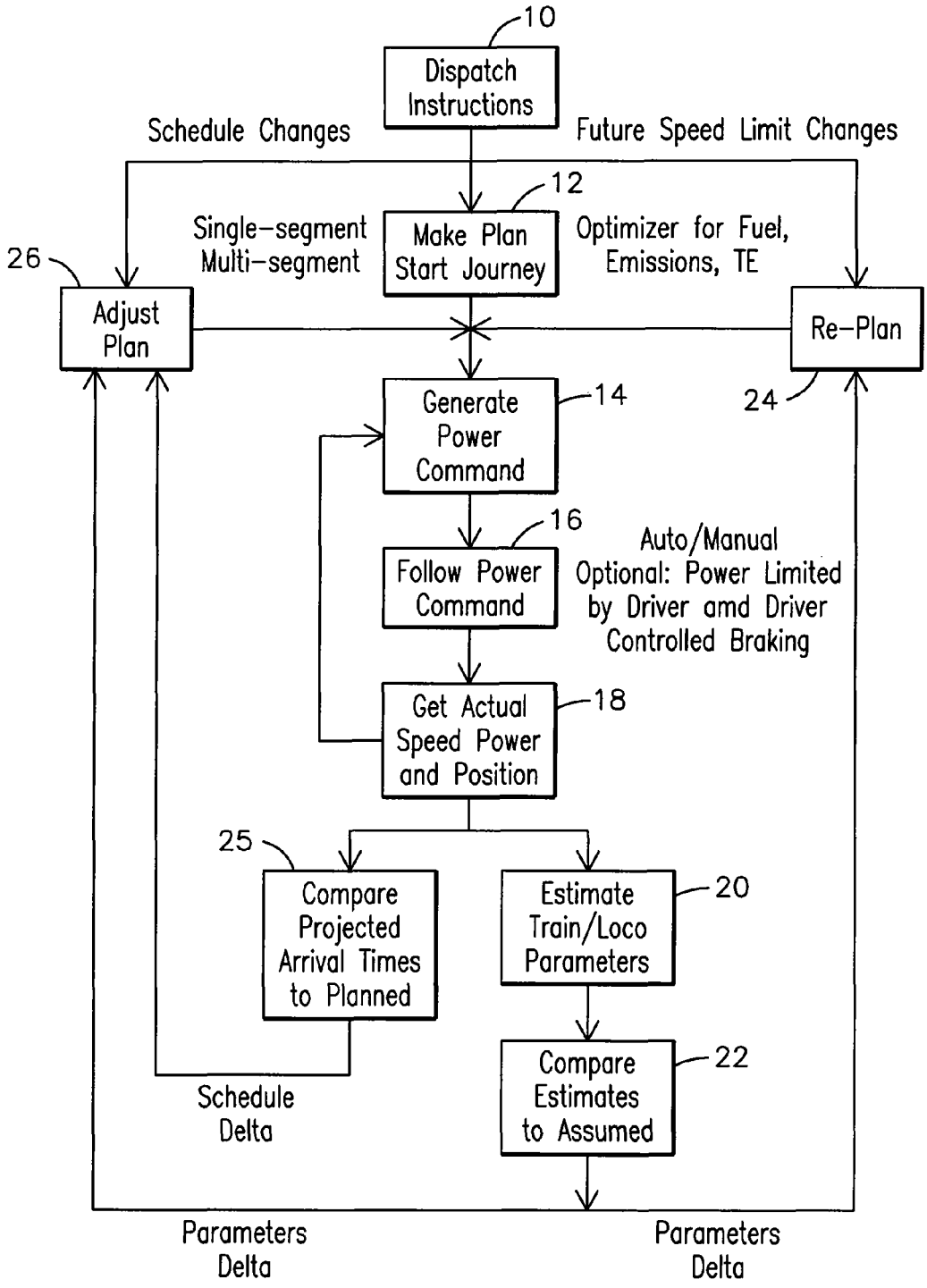
FIG. 1 depicts a flow chart of an exemplary embodiment of a method of the present invention.

Reference will now be made in detail to the embodiments consistent with the invention, examples of which are illustrated in the accompanying drawings. Wherever possible, the same reference numerals used throughout the drawings refer to the same or like parts.

The present invention solves the problems in the art by providing a system, method, and computer implemented method for determining and implementing a driving strategy of a train having a locomotive consist, including determining an approach to monitor and control a train's operations to improve certain objective operating criteria parameter requirements while satisfying schedule and speed constraints. The present invention is also operable when the locomotive consist is in distributed power operations. Persons skilled in the art will recognize that an apparatus, such as a data processing system, including a CPU, memory, I/O, program storage, a connecting bus, and other appropriate components, could be programmed or otherwise designed to facilitate the practice of the method of the invention. Such a system would include appropriate program means for executing the method of the invention.

Also, an article of manufacture, such as a pre-recorded disk or other similar computer program product, for use with a data processing system, could include a storage medium and program means recorded thereon for directing the data processing system to facilitate the practice of the method of the invention. Such apparatus and articles of manufacture also fall within the spirit and scope of the invention.

Broadly speaking, the invention provides a method, apparatus, and program for determining and implementing a driving strategy of a train having a locomotive consist, including determining an approach to monitor and control a train's operations to improve certain objective operating criteria parameter requirements while satisfying schedule and speed constraints. To facilitate an understanding of the present invention, it is described hereinafter with reference to specific implementations thereof. The invention is described in the general context of computer-executable instructions, such as program modules, being executed by a computer. Generally, program modules include routines, programs, objects, components, data structures, etc. that perform particular tasks or implement particular abstract data types. For example, the software programs that underlie the invention can be coded in different languages, for use with different platforms. In the description that follows, examples of the invention are described in the context of a web portal that employs a web browser. It will be appreciated, however, that the principles that underlie the invention can be implemented with other types of computer software technologies as well.

Moreover, those skilled in the art will appreciate that the invention may be practiced with other computer system configurations, including hand-held devices, multiprocessor systems, microprocessor-based or programmable consumer electronics, minicomputers, mainframe computers, and the like. The invention may also be practiced in distributed computing environments where tasks are performed by remote processing devices that are linked through a communications network. In a distributed computing environment, program modules may be located in both local and remote computer storage media including memory storage devices. These local and remote computing environments may be contained entirely within the locomotive, or adjacent locomotives in consist, or off-board in wayside or central offices where wireless communication is used.

Throughout this document the term locomotive "consist" is used. As used herein, a locomotive consist may be described as having one or more locomotives in succession, connected together so as to provide motoring and/or braking capability. The locomotives are connected together where no train cars are in between the locomotives. The train can have more than one consist in its composition. Specifically, there can be a lead consist, and more than one remote consists, such as midway in the line of cars and another remote consist at the end of the train. Each locomotive consist may have a first locomotive and trail locomotive(s). Though a consist is usually viewed as successive locomotives, those skilled in the art will readily recognize that a consist group of locomotives may also be recognized as a consist even when at least a car separates the locomotives, such as when the consist is configured for distributed power operation, wherein throttle and braking commands are relayed from the lead locomotive to the remote trails by a radio link or physical cable. Towards this end, the term locomotive consist should be not be considered a limiting factor when discussing multiple locomotives within the same train.

Referring now to the drawings, embodiments of the present invention will be described. The invention can be implemented in numerous ways, including as a system (including a computer processing system), a method (including a computerized method), an apparatus, a computer readable medium, a computer program product, a graphical user interface, including a web portal, or a data structure tangibly fixed in a computer readable memory. Several embodiments of the invention are discussed below.

FIG. 1 is a flow chart of a method for planning a trip for a powered system (e.g., locomotive or other vehicle), according to an exemplary embodiment of the present invention. As illustrated, instructions are input specific to planning a trip either on board or from a remote location, such as a dispatch center 10. Such input information includes, but is not limited to, train position, consist description (such as locomotive models), locomotive power description, performance of locomotive traction transmission, consumption of engine fuel as a function of output power, cooling characteristics, the intended trip route (effective track grade and curvature as function of milepost or an "effective grade" component to reflect curvature following standard railroad practices), the train represented by car makeup and loading together with effective drag coefficients, trip desired parameters including, but not limited to, start time and location, end location, desired travel time, crew (user and/or operator) identification, crew shift expiration time, and route.

This data may be provided to the locomotive 42 in a number of ways, such as, but not limited to, an operator manually entering this data into the locomotive 42 via an onboard display, inserting a memory device such as a "hard card" and/or USB drive containing the data into a receptacle aboard the locomotive, and transmitting the information via wireless communication from a central or wayside location 41, such as a track signaling device and/or a wayside device, to the locomotive 42. Locomotive 42 and train 31 load characteristics (e.g., drag) may also change over the route (e.g., with altitude, ambient temperature, and condition of the rails and rail-cars), and the plan may be updated to reflect such changes as needed by any of the methods discussed above and/or by real-time autonomous collection of locomotive/train conditions. This includes, for example, changes in locomotive or train characteristics detected by monitoring equipment on or off board the locomotive(s) 42.

The track signal system determines the allowable speed of the train. There are many types of track signal systems and operating rules associated with each of the signals. For example, some signals have a single light (on/off), some signals have a single lens with multiple colors, and some signals have multiple lights and colors. These signals can indicate that the track is clear and the train may proceed at max allowable speed. They can also indicate a reduced speed or stop is required. This reduced speed may need to be achieved immediately, or at a certain location (e.g., prior to the next signal or crossing).

The signal status is communicated to the train and/or operator through various means. Some systems have circuits in the track and inductive pick-up coils on the locomotives. Other systems have wireless communications systems. Signal systems can also require the operator to visually inspect the signal and take the appropriate actions.

The signaling system may interface with the on-board signal system and adjust the locomotive speed according to the inputs and the appropriate operating rules. For signal systems that require the operator to visually inspect the signal status, the operator screen will present the appropriate signal options for the operator to enter based on the train's location. The type of signal systems and operating rules, as a function of location, may be stored in an onboard database 63.

Based on the specification data input into the present invention, an optimal plan which minimizes fuel use and/or emissions produced subject to speed limit constraints along the route with desired start and end times is computed to produce a trip profile 12. The profile contains the optimal speed and power (notch) settings the train is to follow, expressed as a function of distance and/or time, and such train operating limits, including but not limited to, the maximum notch power and brake settings, and speed limits as a function of location, and the expected fuel used and emissions generated. In an exemplary embodiment, the value for the notch setting is selected to obtain throttle change decisions about once every 10 to 30 seconds. Those skilled in the art will readily recognize that the throttle change decisions may occur at a longer or shorter duration, if needed and/or desired to follow an optimal speed profile. In a broader sense, it should be evident to ones skilled in the art that the profile provides power settings for the train, either at the train level, consist level, and/or individual train level. Power comprises braking power, motoring power, and airbrake power. In another embodiment, instead of operating at the traditional discrete notch power settings, the present invention is able to select a continuous power setting determined as optimal for the profile selected. Thus, for example, if an optimal profile specifies a notch setting of 6.8, instead of operating at notch setting 7, the locomotive 42 can operate at 6.8. Allowing such intermediate power settings may bring additional efficiency benefits as described below.

The procedure used to compute the optimal profile can be any number of methods for computing a power sequence that drives the train 31 to minimize fuel and/or emissions subject to locomotive operating and schedule constraints, as summarized below. In some cases the required optimal profile may be close enough to one previously determined, owing to the similarity of the train configuration, route and environmental conditions. In these cases it may be sufficient to look up the driving trajectory within a database 63 and attempt to follow it. When no previously computed plan is suitable, methods to compute a new one include, but are not limited to, direct calculation of the optimal profile using differential equation models which approximate the train physics of motion. The setup involves selection of a quantitative objective function, commonly a weighted sum (integral) of model variables that correspond to rate of fuel consumption and emissions generation plus a term to penalize excessive throttle variation.

An optimal control formulation is set up to minimize the quantitative objective function subject to constraints including but not limited to, speed limits and minimum and maximum power (throttle) settings. Depending on planning objectives at any time, the problem may be implemented flexibly to minimize fuel subject to constraints on emissions and speed limits, or to minimize emissions, subject to constraints on fuel use and arrival time. It is also possible to implement, for example, a goal to minimize the total travel time without constraints on total emissions or fuel use where such relaxation of constraints would be permitted or required for the mission.

Mathematically, the problem to be solved may be stated more precisely. The basic physics are expressed by:

$$\frac{dx}{dt} = v;\ x(0) = 0.0;\ x(T_f) = D$$

$$\frac{dv}{dt} = T_e(u, v) - G_a(x) - R(v);\ v(0) = 0.0;\ v(T_f) = 0.0$$

Where x is the position of the train, v its velocity and t is time (in miles, miles per hour, and minutes or hours as appropriate) and u is the notch (throttle) command input. Further, D denotes the distance to be traveled, Tf the desired arrival time at distance D along the track, Te is the tractive effort produced by the locomotive consist, Ga is the gravitational drag which depends on the train length, train makeup, and terrain on which the train is located, and R is the net speed dependent drag of the locomotive consist and train combination. The initial and final speeds can also be specified, but without loss of generality are taken to be zero here (e.g., train stopped at beginning and end). Finally, the model is readily modified to include other important dynamics such the lag between a change in throttle, u, and the resulting tractive effort or braking. Using this model, an optimal control formulation is set up to minimize the quantitative objective function subject to constraints including but not limited to, speed limits and minimum and maximum power (throttle) settings. Depending on planning objectives at any time, the problem may be setup flexibly to minimize fuel subject to constraints on emissions and speed limits, or to minimize emissions, subject to constraints on fuel use and arrival time.

It is also possible to implement, for example, a goal to minimize the total travel time without constraints on total emissions or fuel use where such relaxation of constraints would be permitted or required for the mission. All these performance measures can be expressed as a linear combination of any of the following:

1. $\min_{u(t)} \int_0^{T_f} F(u(t))dt$ – Minimize total fuel consumption

2. $\min_{u(t)} T_f$ – Minimize Travel Time

3. $\min_{u_i} \sum_{i=2}^{n_d} (u_i - u_{i-1})^2$ – Minimize notch jockeying (piecewise constant input)

$\min_{u(t)} \int_0^{T_f} \left(\frac{du}{dt}\right)^2 dt$ – Minimize notch jockeying (continuous input)

4. Replace the fuel term F in (1) with a term corresponding to emissions production.

A commonly used and representative objective function is thus $$\min_{u(t)} \alpha_1 \int_0^{T_f} F(u(t))dt + \alpha_3 T_f + \alpha_2 \int_0^{T_f} \left(\frac{du}{dt}\right)^2 dt \qquad \text{(OP)}$$

The coefficients of the linear combination will depend on the importance (weight) given for each of the terms. Note that in equation (OP), u(t) is the optimizing variable which is the continuous notch position. If discrete notch is required, e.g., for older locomotives, the solution to equation (OP) would be discretized, which may result in less fuel saving. Finding a minimum time solution ($\alpha 1$ and $\alpha 2$ set to zero) is used to find a lower bound for the achievable travel time ($T_f = T_{fmin}$). In this case, both u(t) and $T_f$ are optimizing variables. In one embodiment, equation (OP) is solved for various values of Tf with $\alpha 3$ set to zero. For those familiar with solutions to such optimal problems, it may be necessary to adjoin constraints, e.g. the speed limits along the path:

$$0 \le v \le SL(x)$$

Or when using minimum time as the objective, that an end point constraint must hold, e.g., total fuel consumed must be less than what is in the tank, e.g. via:

$$0 < \int_0^{T_f} F(u(t))dt \le W_F$$

Here, WF is the fuel remaining in the tank at Tf. Those skilled in the art will readily recognize that equation (OP) can be in other forms as well and that what is presented above is an exemplary equation for use in the present invention.

Reference to emissions in the context of the present invention is actually directed towards cumulative emissions produced in the form of oxides of nitrogen (NOx), unburned hydrocarbons, and particulates. By design, every locomotive must be compliant to EPA standards for brake-specific emissions, and thus when emissions are optimized in the present invention this would be mission total emissions on which there is no specification today. At all times, operations would be compliant with federal EPA mandates. If a key objective during a trip mission is to reduce emissions, the optimal control formulation, equation (OP), would be amended to consider this trip objective. A key flexibility in the optimization setup is that any or all of the trip objectives can vary by geographic region or mission. For example, for a high priority train, minimum time may be the only objective on one route because it is high priority traffic. In another example emission output could vary from state to state along the planned train route.

To solve the resulting optimization problem, in an exemplary embodiment the present invention transcribes a dynamic optimal control problem in the time domain to an equivalent static mathematical programming problem with N decision variables, where the number 'N' depends on the frequency at which throttle and braking adjustments are made and the duration of the trip. For typical problems, this N can be in the thousands. For example, in an exemplary embodiment, suppose a train is traveling a 172-mile stretch of track in the southwest United States. Utilizing the present invention, an exemplary 7.6% saving in fuel used may be realized when comparing a trip determined and followed using the present invention versus an actual driver throttle/speed history where the trip was determined by an operator. The improved savings is realized because the optimization realized by using the present invention produces a driving strategy with both less drag loss and little or no braking loss compared to the trip plan of the operator.

Figure 2:
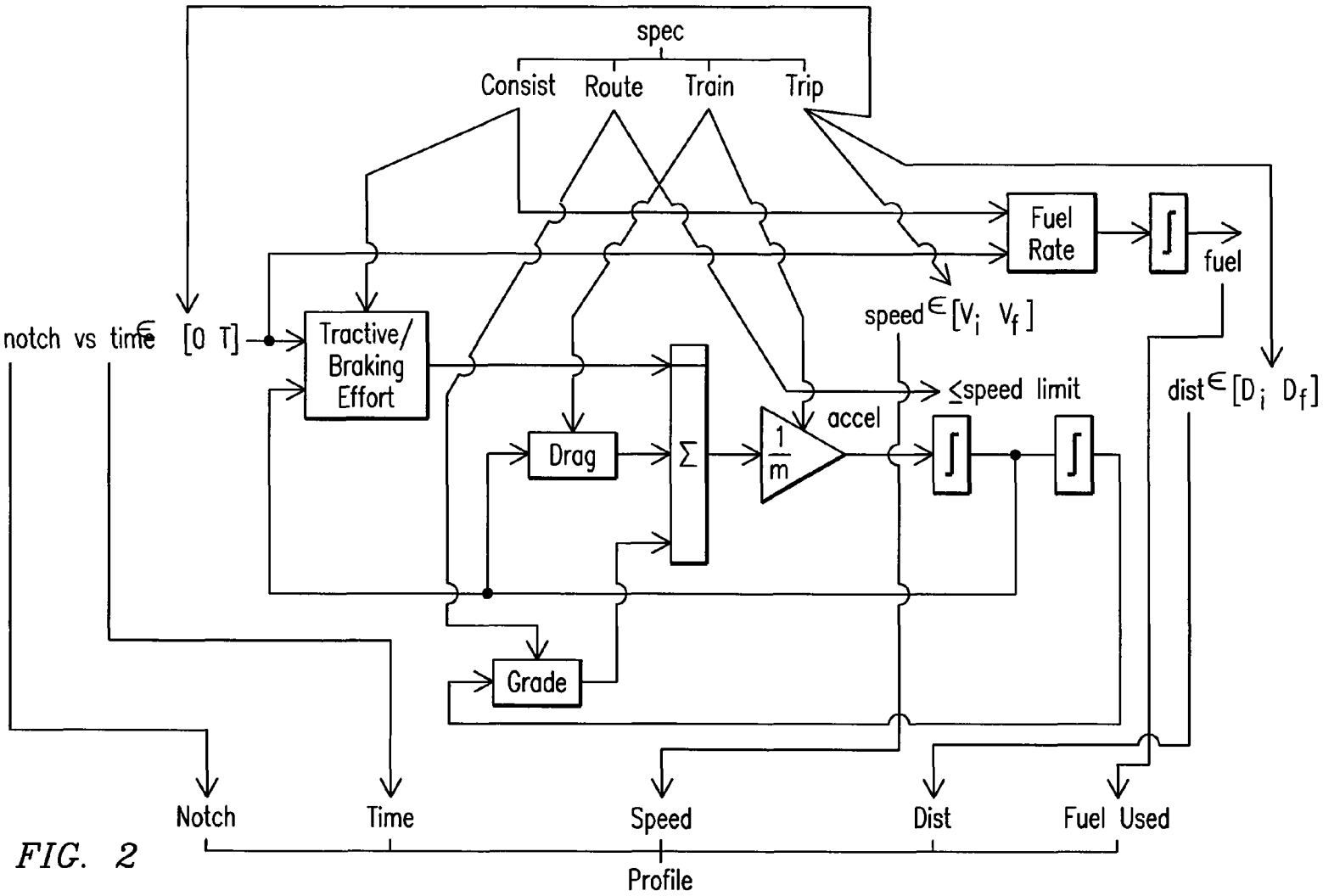
FIG. 2 depicts a simplified model of the train that may be employed.

To make the optimization described above computationally tractable, a simplified model of the train may be employed, such as illustrated in FIG. 2 and the equations discussed above. One possible refinement to the optimal profile is produced by driving a more detailed model with the optimal power sequence generated, to test if other thermal, electrical and mechanical constraints are violated. This leads to a modified profile with speed versus distance that is closest to a run that can be achieved without harming locomotive or train equipment, i.e., satisfying additional implied constraints such thermal and electrical limits on the locomotive and inter-car forces in the train.

Referring back to FIG. 1, once the trip is started 12, power commands are generated 14 to put the plan in motion. Depending on the operational set-up of the present invention, one command is for the locomotive to follow the optimized power command 16 so as to achieve the optimal speed. The present invention obtains actual speed and power information from the locomotive consist of the train 18. Owing to the inevitable approximations in the models used for the optimization, a closed-loop calculation of corrections to optimized power is obtained to track the desired optimal speed. Such corrections of train operating limits can be made automatically or by the operator, who always has ultimate control of the train.

In some cases, the model used in the optimization may differ significantly from the actual train. This can occur for many reasons, including but not limited to, extra cargo pick-ups or setouts, locomotives that fail in route, and errors in the initial database 63 or data entry by the operator. For these reasons a monitoring system is in place that uses real-time train data to estimate locomotive and/or train parameters in real time 20. The estimated parameters are then compared to the assumed parameters used when the trip was initially created 22. Based on any differences in the assumed and estimated values, the trip may be re-planned 24, should large enough savings accrue from a new plan.

Other reasons a trip may be re-planned include directives from a remote location, such as dispatch and/or the operator requesting a change in objectives to be consistent with more global movement planning objectives. Additional global movement planning objectives may include, but are not limited to, other train schedules, allowing exhaust to dissipate from a tunnel, maintenance operations, etc. Another reason may be due to an onboard failure of a component. Strategies for re-planning may be grouped into incremental and major adjustments depending on the severity of the disruption, as discussed in more detail below. In general, a "new" plan must be derived from a solution to the optimization problem equation (OP) described above, but frequently faster approximate solutions can be found, as described herein.

Figure 4:
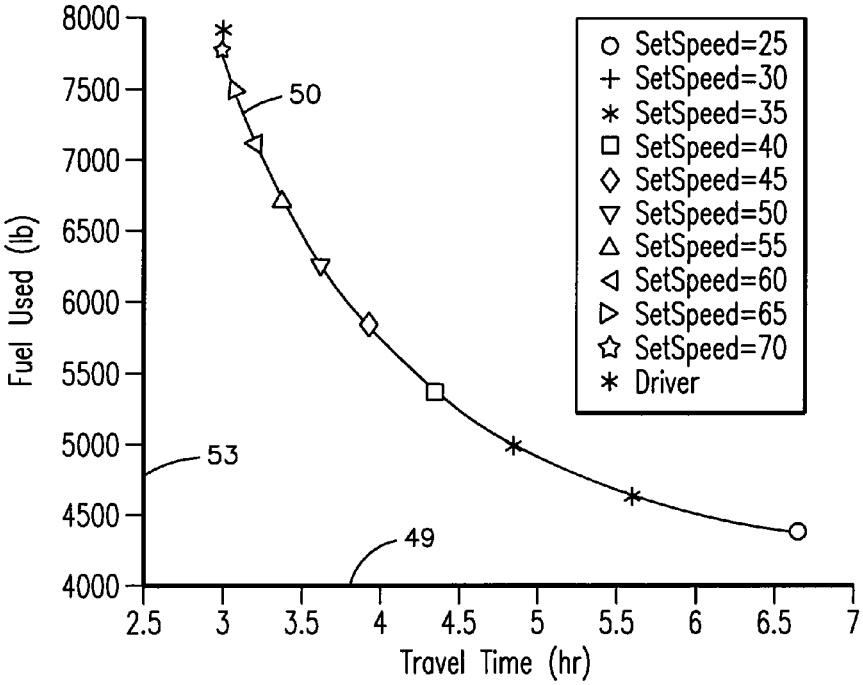
FIG. 4 depicts an exemplary embodiment of a fuel-use/travel time curve.

In operation, the locomotive 42 will continuously monitor system efficiency and continuously update the trip plan based on the actual efficiency measured, whenever such an update would improve trip performance. Re-planning computations may be carried out entirely within the locomotive(s) or fully or partially moved to a remote location, such as dispatch or wayside processing facilities where wireless technology is used to communicate the plans to the locomotive 42. The present invention may also generate efficiency trends that can be used to develop locomotive fleet data regarding efficiency transfer functions. The fleet-wide data may be used when determining the initial trip plan, and may be used for network-wide optimization tradeoff when considering locations of a plurality of trains. For example, the travel-time fuel use tradeoff curve as illustrated in FIG. 4 reflects a capability of a train on a particular route at a current time, updated from ensemble averages collected for many similar trains on the same route. Thus, a central dispatch facility collecting curves like FIG. 4 from many locomotives could use that information to better coordinate overall train movements to achieve a system-wide advantage in fuel use or throughput.

Many events in daily operations can lead to a need to generate or modify a currently executing plan, where it desired to keep the same trip objectives, for example when a train is not on schedule for planned meet or pass with another train and it needs to make up time. Using the actual speed, power, and location of the locomotive, a comparison is made between a planned arrival time and the currently estimated (predicted) arrival time 25. Based on a difference in the times, as well as the difference in parameters (detected or changed by dispatch or the operator), the plan is adjusted 26. This adjustment may be made automatically according to a railroad company's desire for how such departures from plan should be handled, or alternatives may be manually proposed for the on-board operator and dispatcher to jointly decide the best way to get back on plan. Whenever a plan is updated but where the original objectives, (such as but not limited to arrival time) remain the same, additional changes may be factored in concurrently, e.g., new future speed limit changes, which could affect the feasibility of ever recovering the original plan. In such instances, if the original trip plan cannot be maintained, or in other words the train is unable to meet the original trip plan objectives, as discussed herein other trip plan(s) may be presented to the operator and/or remote facility, or dispatch.

A re-plan may also be made when it is desired to change the original objectives. Such re-planning can be done at either fixed preplanned times, manually at the discretion of the operator or dispatcher, or autonomously when predefined limits, such as train operating limits, are exceeded. For example, if the current plan execution is running late by more than a specified threshold, such as thirty minutes, the present invention can re-plan the trip to accommodate the delay at the expense of increased fuel use, as described above, or to alert the operator and dispatcher how much of the time can be made up at all (i.e., what minimum time to go or the maximum fuel that can be saved within a time constraint). Other triggers for re-plan can also be envisioned based on fuel consumed or the health of the power consist, including but not limited time of arrival, loss of horsepower due to equipment failure and/or equipment temporary malfunction (such as operating too hot or too cold), and/or detection of gross setup errors, such as in the assumed train load. That is, if the change reflects impairment in the locomotive performance for the current trip, these may be factored into the models and/or equations used in the optimization.

Changes in plan objectives can also arise from a need to coordinate events where the plan for one train compromises the ability of another train to meet objectives and arbitration at a different level, e.g., the dispatch office is required. For example, the coordination of meets and passes may be further optimized through train-to-train communications. Thus, as an example, if a train knows that it is behind schedule in reaching a location for a meet and/or pass, communications from the other train can notify the late train (and/or dispatch). The operator can then enter information pertaining to being late into the system of the present invention, which recalculates the train's trip plan. The system of the present invention can also be used at a high level, or network-level, to allow a dispatch to determine which train should slow down or speed up should a scheduled meet and/or pass time constraint may not be met. As discussed herein, this is accomplished by trains transmitting data to the dispatch to prioritize how each train should change its planning objective. A choice could be based on either schedule or fuel saving benefits, depending on the situation.

Figure 5:
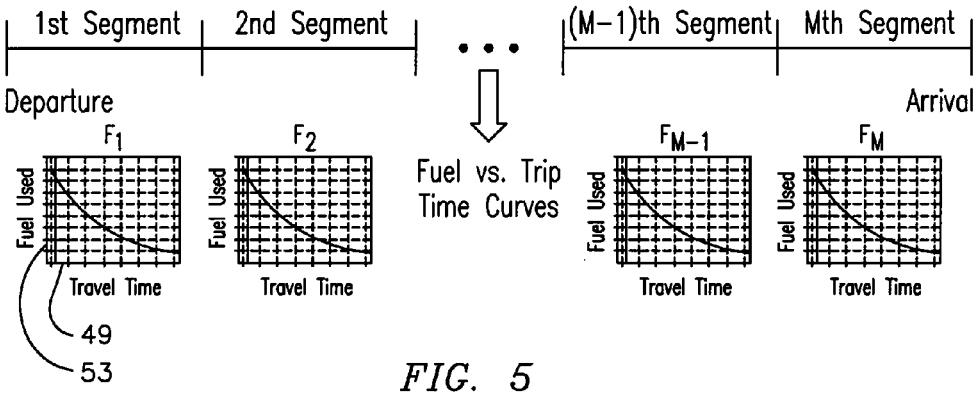
FIG. 5 depicts an exemplary embodiment of segmentation decomposition for trip planning.

For any of the manually or automatically initiated re-plans, the system of the present invention may present more than one trip plan to the operator. In an exemplary embodiment, the present invention will present different profiles to the operator, allowing the operator to select the arrival time and understand the corresponding fuel and/or emission impact. Such information can also be provided to the dispatch for similar consideration, either as a simple list of alternatives or as a plurality of tradeoff curves such as illustrated in FIG. 5.

Embodiments of the present invention have the ability to learn and adapt to key changes in the train and power consist which can be incorporated either in the current plan and/or in future plans. For example, one of the triggers discussed above is loss of horsepower. When building up horsepower over time, either after a loss of horsepower or when beginning a trip, transition logic is utilized to determine when desired horsepower is achieved. This information can be saved in the locomotive database 61 for use in optimizing either future trips or the current trip should loss of horsepower occur again.

Figure 3:
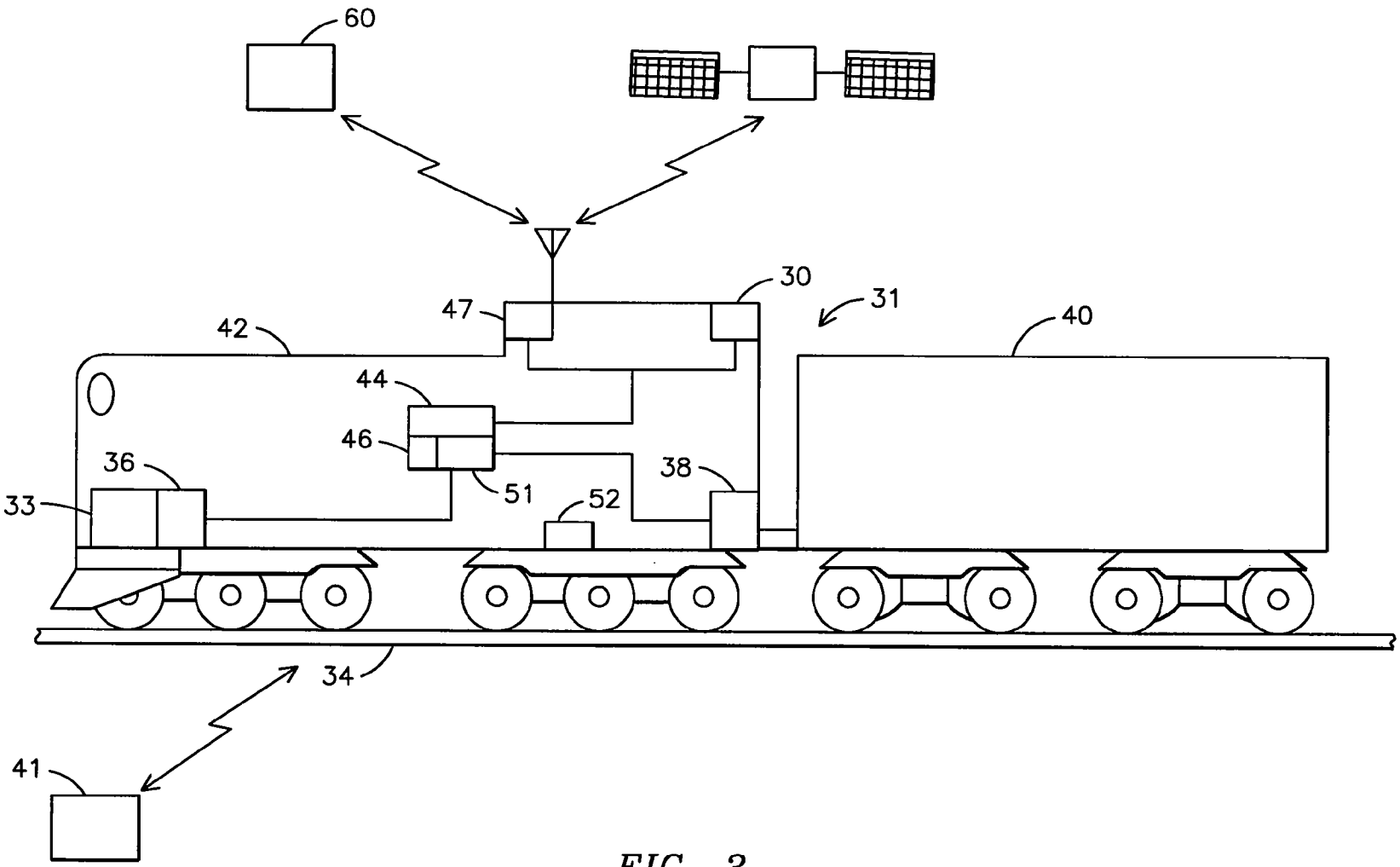
FIG. 3 depicts an exemplary embodiment of elements of the present invention.

FIG. 3 depicts various elements that may be part of a trip optimizer system, according to an exemplary embodiment of the present invention. A locator element 30 to determine a location of the train 31 is provided. The locator element 30 can be a GPS sensor, or a system of sensors, that determines a location of the train 31. Examples of such other systems may include, but are not limited to, wayside devices, such as radio frequency automatic equipment identification (RF AEI) tags, dispatch, and/or video determination. Another system may include the tachometer(s) aboard a locomotive and distance calculations from a reference point. As discussed previously, a wireless communication system 47 may also be provided to allow for communications between trains and/or with a remote location, such as dispatch. Information about travel locations may also be transferred from other trains.

A track characterization element 33 to provide information about a track, principally grade and elevation and curvature information, is also provided. The track characterization element 33 may include an on-board track integrity database 36. Sensors 38 are used to measure a tractive effort 40 being hauled by the locomotive consist 42, throttle setting of the locomotive consist 42, locomotive consist 42 configuration information, speed of the locomotive consist 42, individual locomotive configuration, individual locomotive capability, etc. In an exemplary embodiment the locomotive consist 42 configuration information may be loaded without the use of a sensor 38, but is input in another manner as discussed above. Furthermore, the health of the locomotives in the consist may also be considered. For example, if one locomotive in the consist is unable to operate above power notch level 5, this information is used when optimizing the trip plan.

Information from the locator element may also be used to determine an appropriate arrival time of the train 31. For example, if there is a train 31 moving along a track 34 towards a destination and no train is following behind it, and the train has no fixed arrival deadline to adhere to, the locator element, including but not limited to RF AEI tags, dispatch, and/or video determination, may be used to gage the exact location of the train 31. Furthermore, inputs from these signaling systems may be used to adjust the train speed. Using the on-board track database, discussed below, and the locator element, such as GPS, the present invention can adjust the operator interface to reflect the signaling system state at the given locomotive location. In a situation where signal states would indicate restrictive speeds ahead, the planner may elect to slow the train to conserve fuel consumption.

Information from the locator element 30 may also be used to change planning objectives as a function of distance to destination. For example, owing to inevitable uncertainties about congestion along the route, "faster" time objectives on the early part of a route may be employed as a hedge against delays that statistically occur later. If it happens on a particular trip that delays do not occur, the objectives on a latter part of the journey can be modified to exploit the built-in slack time that was banked earlier, and thereby recover some fuel efficiency. A similar strategy could be invoked with respect to emissions restrictive objectives, e.g. approaching an urban area.

As an example of the hedging strategy, if a trip is planned from New York to Chicago, the system may have an option to operate the train slower at either the beginning of the trip or at the middle of the trip or at the end of the trip. The present invention would optimize the trip plan to allow for slower operation at the end of the trip since unknown constraints, such as but not limited to weather conditions, track maintenance, etc., may develop and become known during the trip. As another consideration, if traditionally congested areas are known, the plan is developed with an option to have more flexibility around these traditionally congested regions. Therefore, the present invention may also consider weighting/penalty as a function of time/distance into the future and/or based on known/past experience. Those skilled in the art will readily recognize that such planning and re-planning to take into consideration weather conditions, track conditions, other trains on the track, etc., may be taken into consideration at any time during the trip wherein the trip plan is adjust accordingly.

FIG. 3 further discloses other elements that may be part of the trip planner system of the present invention. A processor 44 is provided that is operable to receive information from the locator element 30, track characterizing element 33, and sensors 38. An algorithm 46 (e.g., implemented as a set of computer program/instructions) operates within the processor 44. The algorithm 46 is used to compute an optimized trip plan based on parameters involving the locomotive 42, train 31, track 34, and objectives of the mission as described above. In an exemplary embodiment, the trip plan is established based on models for train behavior as the train 31 moves along the track 34 as a solution of non-linear differential equations derived from physics with simplifying assumptions that are provided in the algorithm. The algorithm 46 has access to the information from the locator element 30, track characterizing element 33 and/or sensors 38 to create a trip plan minimizing fuel consumption of a locomotive consist 42, minimizing emissions of a locomotive consist 42, establishing a desired trip time, and/or ensuring proper crew operating time aboard the locomotive consist 42. In an exemplary embodiment, a driver or operator, and/or controller element, 51 is also provided. As discussed herein the controller element 51 is used for controlling the train as it follows the trip plan. In an exemplary embodiment discussed further herein, the controller element 51 makes train operating decisions autonomously. In another exemplary embodiment the operator may be involved with directing the train to follow the trip plan.

A feature of an exemplary embodiment of the present invention is the ability to initially create and quickly modify "on the fly" any plan that is being executed. This includes creating the initial plan when a long distance is involved, owing to the complexity of the plan optimization algorithm. When a total length of a trip profile exceeds a given distance, an algorithm 46 may be used to segment the mission, wherein the mission may be divided by waypoints. Though only a single algorithm 46 is discussed, those skilled in the art will readily recognize that more than one algorithm may be used (or that the same algorithm may be executed a plurality of times) wherein the algorithms may be connected together. The waypoint may include natural locations where the train 31 stops, such as, but not limited to, sidings where a meet with opposing traffic (or pass with a train behind the current train) is scheduled to occur on a single-track rail, or at yard sidings or industry where cars are to be picked up and set out, and locations of planned work. At such waypoints, the train 31 may be required to be at the location at a scheduled time and be stopped or moving with speed in a specified range. The time duration from arrival to departure at waypoints is called "dwell time."

In an exemplary embodiment, the trip planner system of the present invention breaks down a longer trip into smaller segments in a special systematic way. Each segment can be somewhat arbitrary in length, but is typically picked at a natural location such as a stop or significant speed restriction, or at key mileposts that define junctions with other routes. Given a partition, or segment, selected in this way, a driving profile is created for each segment of track as a function of travel time taken as an independent variable, such as shown in FIG. 4. The fuel used/travel-time tradeoff associated with each segment can be computed prior to the train 31 reaching that segment of track. A total trip plan can be created from the driving profiles created for each segment. The system distributes travel time amongst all the segments of the trip in an optimal way so that the total trip time required is satisfied and total fuel consumed over all the segments is as small as possible. An exemplary 3-segment trip is disclosed in FIG. 6 and discussed below. Those skilled in the art will recognize however, through segments are discussed, the trip plan may comprise a single segment representing the complete trip.

FIG. 4 depicts an exemplary embodiment of a fuel-use/travel time curve 50. As mentioned previously, such a curve 50 is created when calculating an optimal trip profile for various travel times for each segment. That is, for a given travel time 51, fuel used 52 is the result of a detailed driving profile computed as described above. Once travel times for each segment are allocated, a power/speed plan is determined for each segment from the previously computed solutions. If there are any waypoint constraints on speed between the segments, such as, but not limited to, a change in a speed limit, they are matched up during creation of the optimal trip profile. If speed restrictions change in only a single segment, the fuel use/travel-time curve 50 has to be re-computed for only the segment changed. This reduces time for having to re-calculate more parts, or segments, of the trip. If the locomotive consist or train changes significantly along the route, e.g., from loss of a locomotive or pickup or set-out of cars, then driving profiles for all subsequent segments must be recomputed, thereby creating new instances of the curve 50. These new curves 50 would then be used along with new schedule objectives to plan the remaining trip.

Once a trip plan is created as discussed above, a trajectory of speed and power versus distance is used to reach a destination with minimum fuel use and/or emissions at the required trip time. There are several ways in which to execute the trip plan. As provided below in more detail, in one exemplary embodiment, when in an operator "coaching mode," information is displayed to the operator for the operator to follow to achieve the required power and speed determined according to the optimal trip plan. In this mode, the operating information includes suggested operating conditions that the operator should use. In another exemplary embodiment, acceleration and maintaining a constant speed are autonomously performed. However, when the train 31 must be slowed, the operator is responsible for applying a braking system 52. In another exemplary embodiment, commands for powering and braking are provided as required to follow the desired speed-distance path.

Feedback control strategies are used to provide corrections to the power control sequence in the profile to correct for events such as, but not limited to, train load variations caused by fluctuating head winds and/or tail winds. Another such error may be caused by an error in train parameters, such as, but not limited to, train mass and/or drag, when compared to assumptions in the optimized trip plan. A third type of error may occur with information contained in the track database 36. Another possible error may involve un-modeled performance differences due to the locomotive engine, traction motor thermal duration, and/or other factors. Feedback control strategies compare the actual speed as a function of position to the speed in the desired optimal profile. Based on this difference, a correction to the optimal power profile is added to drive the actual velocity toward the optimal profile. To ensure stable regulation, a compensation algorithm may be provided which filters the feedback speeds into power corrections so that closed-performance stability is ensured. Compensation may include standard dynamic compensation as used by those skilled in the art of control system design to meet performance objectives.

Exemplary embodiments of the present invention allow the simplest and therefore fastest means to accommodate changes in trip objectives, which is the rule, rather than the exception in railroad operations. In an exemplary embodiment, to determine the fuel-optimal trip from point A to point B where there are stops along the way, and for updating the trip for the remainder of the trip once the trip has begun, a sub-optimal decomposition method is usable for finding an optimal trip profile. Using modeling methods, the computation method can find the trip plan with specified travel time and initial and final speeds, so as to satisfy all the speed limits and locomotive capability constraints when there are stops. Though the following discussion is directed towards optimizing fuel use, it can also be applied to optimize other factors, such as, but not limited to, emissions, schedule, crew comfort, and load impact. The method may be used at the outset in developing a trip plan, and more importantly to adapting to changes in objectives after initiating a trip.

Figure 6:
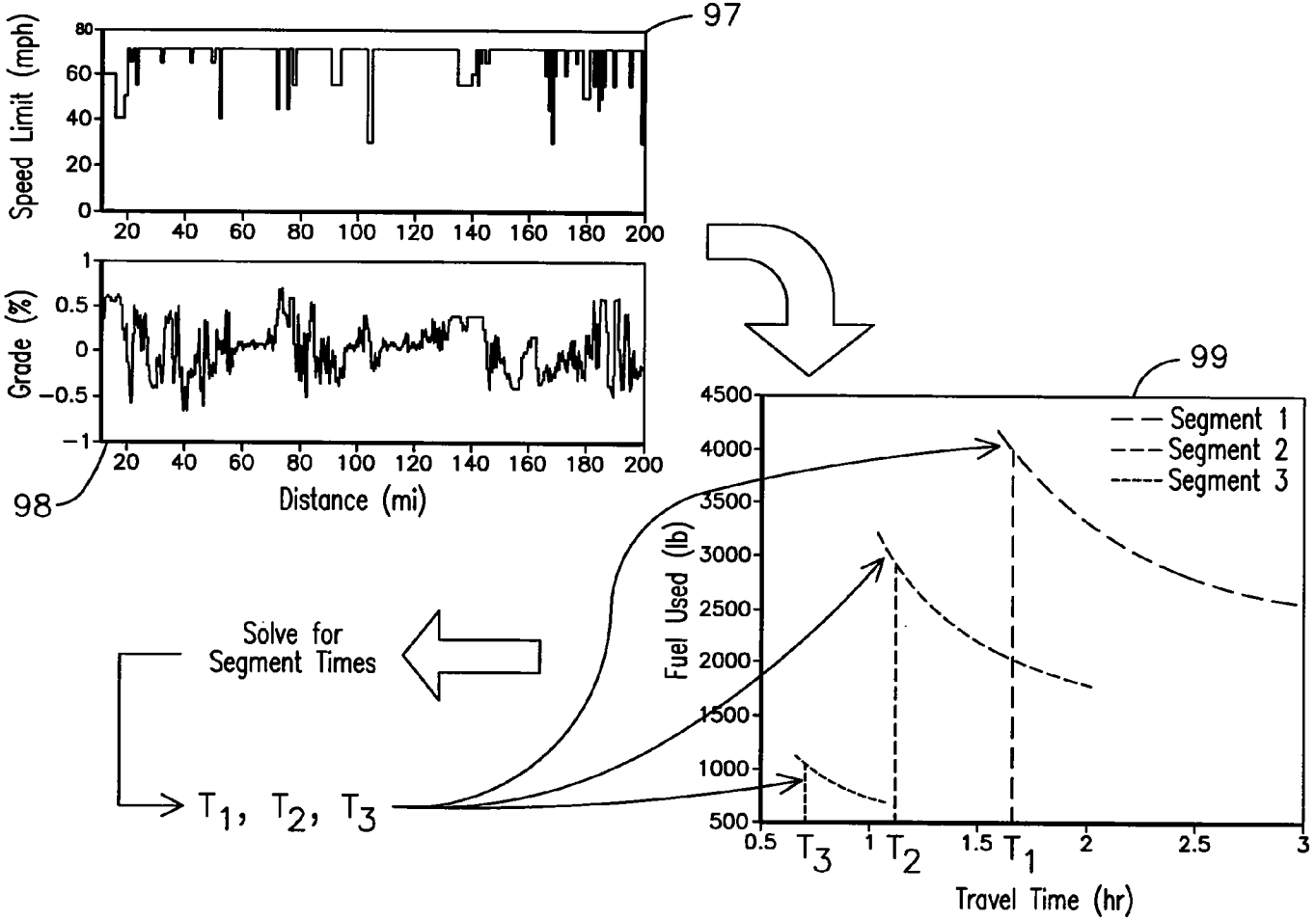
FIG. 6 depicts an exemplary embodiment of a segmentation example.

As discussed herein, embodiments of the present invention may employ a setup as illustrated in the flow chart depicted in FIG. 5, and as an exemplary 3-segment example depicted in detail in FIG. 6. As illustrated, the trip may be broken into two or more segments, T1, T2, and T3. (As noted above, it is possible to consider the trip as a single segment.) As discussed herein, the segment boundaries may not result in equal segments. Instead, the segments may use natural or mission specific boundaries. Optimal trip plans are pre-computed for each segment. If fuel use versus trip time is the trip object to be met, fuel versus trip time curves are built for each segment. As discussed herein, the curves may be based on other factors, wherein the factors are objectives to be met with a trip plan. When trip time is the parameter being determined, trip time for each segment is computed while satisfying the overall trip time constraints. FIG. 6 illustrates speed limits 97 for an exemplary 3-segment 200 mile trip. Further illustrated are grade changes 98 over the 200 mile trip. A combined chart 99 illustrating curves for each segment of the trip of fuel used over the travel time is also shown.

Using the optimal control setup described previously, the present computation method can find the trip plan with specified travel time and initial and final speeds, so as to satisfy all the speed limits and locomotive capability constraints when there are stops. Though the following detailed discussion is directed towards optimizing fuel use, it can also be applied to optimize other factors as discussed herein, such as, but not limited to, emissions. A key flexibility is to accommodate desired dwell time at stops and to consider constraints on earliest arrival and departure at a location as may be required, for example, in single-track operations where the time to be in or get by a siding is critical.

Exemplary embodiments of the present invention find a fuel-optimal trip from distance $D_0$ to $D_M$, traveled in time T, with M−1 intermediate stops at $D_1, \ldots, D_{M-1}$, and with the arrival and departure times at these stops constrained by $$t_{min}(i) \le t_{arr}(D_i) \le t_{max}(i) - \Delta t_i$$

$$t_{arr}(D_i) + \Delta t_i \le t_{dep}(D_i) \le t_{max}(i) \quad i = 1, \ldots, -1$$

where $t_{arr}(D_i)$, $t_{dep}(D_i)$, and $\Delta t_i$ are the arrival, departure, and minimum stop time at the ith stop, respectively. Assuming that fuel-optimality implies minimizing stop time, therefore which eliminates the second inequality above. Suppose for each i=1, . . . , M, the fuel-optimal trip from $D_{i-1}$ to $D_i$ for travel time t, $T_{min}(i) \le t \le T_{max}(i)$, is known. Let $F_i(t)$ be the fuel-use corresponding to this trip. If the travel time from $D_{j-1}$ to $D_j$ is denoted $T_j$, then the arrival time at $D_i$ is given by $$t_{arr}(D_i) = \sum_{j=1}^{i} (T_j + \Delta t_{j-1})$$

where $\Delta t_0$ is defined to be zero. The fuel-optimal trip from $D_0$ to $D_M$ for travel time T is then obtained by finding $T_i$, i=1, . . . , M, which minimize $$\sum_{i=1}^{M} F_i(T_i) \quad T_{min}(i) \le T_i \le T_{max}(i)$$

subject to $$t_{min}(i) \le \sum_{j=1}^{i} (T_j + \Delta t_{j-1}) \le t_{max}(i) - \Delta t_i \quad i = 1, \ldots, M-1$$

-continued $$\sum_{j=1}^{M} (T_j + \Delta t_{j-1}) = T$$

Once a trip is underway, the issue is re-determining the fuel-optimal solution for the remainder of a trip (originally from $D_0$ to $D_M$ in time T) as the trip is traveled, but where disturbances preclude following the fuel-optimal solution. Let the current distance and speed be x and v, respectively, where $D_{i-1} < x \le D_i$. Also, let the current time since the beginning of the trip be tact. Then the fuel-optimal solution for the remainder of the trip from x to $D_M$, which retains the original arrival time at $D_M$, is obtained by finding $\tilde{T}_i$, $T_j$, j=i+1, . . . M, which minimize $$\tilde{F}_i(\tilde{T}_i, x, v) + \sum_{j=i+1}^{M} F_j(T_j)$$

subject to $$t_{min}(i) \le t_{act} + \tilde{T}_i \le t_{max}(i) - \Delta t_i$$

$$t_{min}(k) \le t_{act} + \tilde{T}_i + \sum_{j=i+1}^{k} (T_j + \Delta t_{j-1}) \le t_{max}(k) - \Delta t_k$$

$$k = i+1, \ldots, M-1$$

$$t_{act} + \tilde{T}_i + \sum_{j=i+1}^{M} (T_j + \Delta t_{j-1}) = T$$

Here, $\tilde{F}_i(t,x,v)$ is the fuel-used of the optimal trip from x to $D_i$, traveled in time t, with initial speed at x of v.

As discussed above, an exemplary way to enable more efficient re-planning is to construct the optimal solution for a stop-to-stop trip from partitioned segments. For the trip from $D_{i-1}$ to $D_i$, with travel time $T_i$, choose a set of intermediate points $D_{ij}$, j=1, . . . , $N_i$−1. Let $D_{i0}=D_{i-1}$ and $D_{iN_i}=D_i$. Then express the fuel-use for the optimal trip from $D_{i-1}$ to $D_i$ as:

$$F_i(t) = \sum_{j=1}^{N_i} f_{ij}(t_{ij} - t_{i,j-1}, v_{i,j-1}, v_{ij})$$

where $f_{ij}(t, v_{i,j-1}, v_{ij})$ is the fuel-use for the optimal trip from $D_{i,j-1}$ to $D_{ij}$, traveled in time t, with initial and final speeds of $v_{ij-1}$ and $v_{ij}$. Furthermore, $t_{ij}$ is the time in the optimal trip corresponding to distance $D_{ij}$. By definition, $t_{iN_i} - t_{i0} = T_i$. Since the train is stopped at $D_{i0}$ and $D_{iN_i}$, $v_{i0} = v_{iN_i} = 0$.

The above expression enables the function $F_i(t)$ to be alternatively determined by first determining the functions $f_{ij}(\bullet)$, $1 \le j \le N_i$, then finding $\tau_{ij}$, $1 \le j \le N_i$ and $v_{ij}$, $1 \le j < N_i$, which minimize:

$$F_i(t) = \sum_{j=1}^{N_i} f_{ij}(\tau_{ij}, v_{i,j-1}, v_{ij})$$

subject to $$\sum_{j=1}^{N_i} \tau_{ij} = T_i$$

$$v_{min}(i, j) \le v_{ij} \le v_{max}(i, j) \quad j = 1, \ldots, N_i - 1$$

$$v_{i0} = v_{iN_i} = 0$$

By choosing $D_{ij}$ (e.g., at speed restrictions or meeting points), $v_{max}(i,j)-v_{min}(i,j)$ can be minimized, thus minimizing the domain over which $f_{ij}(\ )$ needs to be known.

Based on the partitioning above, a simpler suboptimal re-planning approach than that described above is to restrict re-planning to times when the train is at distance points $D_{ij}$, $1 \le i \le M$, $1 \le j \le N_i$. At point $D_{ij}$, the new optimal trip from $D_{ij}$ to $D_M$ can be determined by finding $\tau_{ik}$, $j<k \le N_i$, $v_{ik}$, $j<k<N_i$, and $\tau_{mn}$, $i<m \le M$, $1 \le n \le N_m$, $v_{mn}$, $i<m \le M$, $1 \le n < N_m$, which minimize:

$$\sum_{k=j+1}^{N_i} f_{ik}(\tau_{ik}, v_{i,k-1}, v_{ik}) + \sum_{m=i+1}^{M} \sum_{n=1}^{N_m} f_{mn}(\tau_{mn}, v_{m,n-1}, v_{mn})$$

subject to $$t_{min}(i) \le t_{act} + \sum_{k=j+1}^{N_i} \tau_{ik} \le t_{max}(i) - \Delta t_i$$

$$t_{min}(n) \le t_{act} + \sum_{k=j+1}^{N_i} \tau_{ik} + \sum_{m=i+1}^{n} (T_m + \Delta t_{m-1}) \le t_{max}(n) - \Delta t_n$$

$$n = i+1, \ldots, M-1$$

$$t_{act} + \sum_{k=j+1}^{N_i} \tau_{ik} + \sum_{m=i+1}^{M} (T_m + \Delta t_{m-1}) = T$$

where $$T_m = \sum_{n=1}^{N_m} \tau_{mn}$$

A further simplification is obtained by waiting on the re-computation of $T_m$, $i<m \le M$, until distance point $D_i$ is reached. In this way, at points $D_{ij}$ between $D_{i-1}$, and $D_i$, the minimization above needs only be performed over $\tau_{ik}$, $j<k \le N_i$, $v_{ik}$, $j<k<N_i$. $T_i$ is increased as needed to accommodate any longer actual travel time from $D_{i-1}$ to $D_{ij}$ than planned. This increase is later compensated, if possible, by the re-computation of $T_m$, $i<m \le M$, at distance point $D_i$.

With respect to the closed-loop configuration disclosed above, the total input energy required to move a train 31 from point A to point B consists of the sum of four components, specifically, difference in kinetic energy between points A and B; difference in potential energy between points A and B; energy loss due to friction and other drag losses; and energy dissipated by the application of brakes. Assuming the start and end speeds to be equal (e.g., stationary), the first component is zero. Furthermore, the second component is independent of driving strategy. Thus, it suffices to minimize the sum of the last two components.

Following a constant speed profile minimizes drag loss. Following a constant speed profile also minimizes total energy input when braking is not needed to maintain constant speed. However, if braking is required to maintain constant speed, applying braking just to maintain constant speed will most likely increase total required energy because of the need to replenish the energy dissipated by the brakes. A possibility exists that some braking may actually reduce total energy usage if the additional brake loss is more than offset by the resultant decrease in drag loss caused by braking, by reducing speed variation.

After completing a re-plan from the collection of events described above, the new optimal notch/speed plan can be followed using the closed loop control described herein. However, in some situations there may not be enough time to carry out the segment decomposed planning described above, and particularly when there are critical speed restrictions that must be respected, an alternative is needed. The present invention accomplishes this with an algorithm referred to as "smart cruise control." The smart cruise control algorithm is an efficient way to generate, on the fly, an energy-efficient (hence fuel-efficient) sub-optimal prescription for driving the train 31 over a known terrain. This algorithm assumes knowledge of the position of the train 31 along the track 34 at all times, as well as knowledge of the grade and curvature of the track versus position. The method relies on a point-mass model for the motion of the train 31, whose parameters may be adaptively estimated from online measurements of train motion as described earlier.

The smart cruise control algorithm has three principal components, specifically, a modified speed limit profile that serves as an energy-efficient guide around speed limit reductions; an ideal throttle or dynamic brake setting profile that attempts to balance between minimizing speed variation and braking; and a mechanism for combining the latter two components to produce a notch command, employing a speed feedback loop to compensate for mismatches of modeled parameters when compared to reality parameters. Smart cruise control can accommodate strategies in the present invention that do no active braking (e.g., the driver is signaled and assumed to provide the requisite braking) or a variant that does active braking.

With respect to the cruise control algorithm that does not control dynamic braking, the three exemplary components are a modified speed limit profile that serves as an energy-efficient guide around speed limit reductions, a notification signal directed to notify the operator when braking should be applied, an ideal throttle profile that attempts to balance between minimizing speed variations and notifying the operator to apply braking, a mechanism employing a feedback loop to compensate for mismatches of model parameters to reality parameters.

Also included in the present invention is an approach to identify key parameter values of the train 31. For example, with respect to estimating train mass, a Kalman filter and a recursive least-squares approach may be utilized to detect errors that may develop over time.

Figure 7:
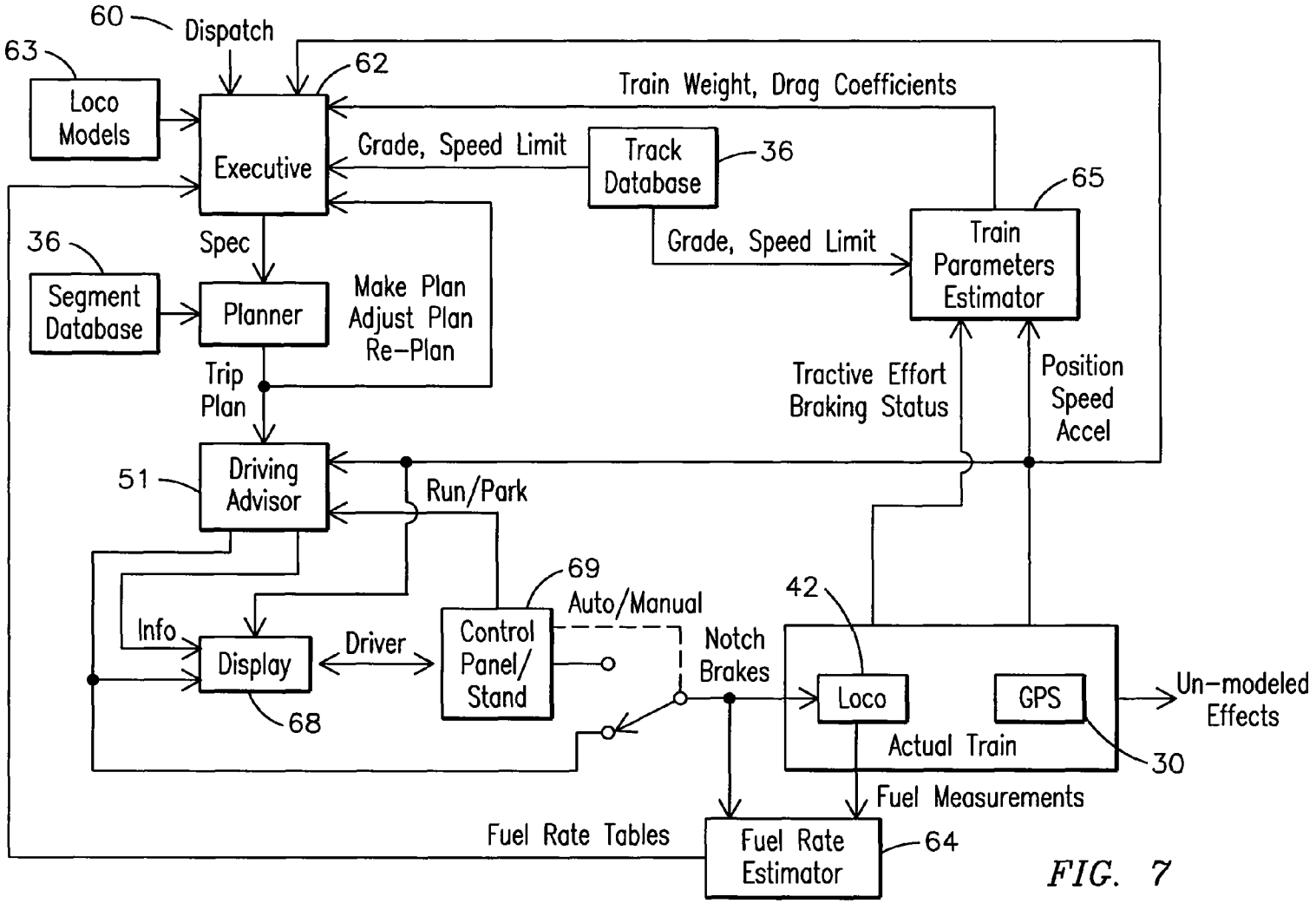
FIG. 7 is a schematic view of an embodiment of a system according to the present invention.

FIG. 7 depicts a schematic view of the trip planner system, according to an additional embodiment of the present invention. As discussed previously, a remote facility, such as a dispatch 60, can provide information to an executive control element 62. Also supplied to the executive control element 62 is information from a locomotive modeling database 63, information from a track database 36 such as, but not limited to, track grade information and speed limit information, estimated train parameters such as, but not limited to, train weight and drag coefficients, and fuel rate tables from a fuel rate estimator 64. The executive control element 62 supplies information to the planner 12, which is disclosed in more detail in FIG. 1. Once a trip plan has been calculated, the plan is supplied to a driving advisor, driver or controller element 51. The trip plan is also supplied to the executive control element 62 so that it can compare the trip when other new data is provided.

As discussed above, the driving advisor 51 can automatically set a notch power, either a pre-established notch setting or an optimum continuous notch power. In addition to supplying a speed command to the locomotive 31, a display 68 is provided so that the operator can view what the planner has recommended. The operator also has access to a control panel 69. Through the control panel 69 the operator can decide whether to apply the notch power recommended. Towards this end, the operator may limit a targeted or recommended power. That is, at any time the operator always has final authority over what power setting the locomotive consist will operate at. This includes deciding whether to apply braking if the trip plan recommends slowing the train 31. For example, if operating in dark territory, or where information from wayside equipment cannot electronically transmit information to a train and instead the operator views visual signals from the wayside equipment, the operator inputs commands based on information contained in the track database and visual signals from the wayside equipment. Based on how the train 31 is functioning, information regarding fuel measurement is supplied to the fuel rate estimator 64. Since direct measurement of fuel flows is not typically available in a locomotive consist, all information on fuel consumed so far within a trip and projections into the future following optimal plans is carried out using calibrated physics models such as those used in developing the optimal plans. For example, such predictions may include, but are not limited to, the use of measured gross horsepower and known fuel characteristics to derive the cumulative fuel used.

The train 31 also has a locator device 30 such as a GPS sensor, as discussed above. Information is supplied to the train parameters estimator 65. Such information may include, but is not limited to, GPS sensor data, tractive/braking effort data, braking status data, speed and any changes in speed data. With information regarding grade and speed limit information, train weight and drag coefficients information is supplied to the executive control element 62.

Exemplary embodiments of the present invention may also allow for the use of continuously variable power throughout the optimization planning and closed loop control implementation. In a conventional locomotive, power is typically quantized to eight discrete levels. Modern locomotives can realize continuous variation in horsepower which may be incorporated into the previously described optimization methods. With continuous power, the locomotive 42 can further optimize operating conditions, e.g., by minimizing auxiliary loads and power transmission losses, and fine tuning engine horsepower regions of optimum efficiency, or to points of increased emissions margins. Examples include, but are not limited to, minimizing cooling system losses, adjusting alternator voltages, adjusting engine speeds, and reducing number of powered axles. Further, the locomotive 42 may use the on-board track database 36 and the forecasted performance requirements to minimize auxiliary loads and power transmission losses to provide optimum efficiency for the target fuel consumption/emissions. Examples include, but are not limited to, reducing a number of powered axles on flat terrain and pre-cooling the locomotive engine prior to entering a tunnel.

Exemplary embodiments of the present invention may also use the on-board track database 36 and the forecasted performance to adjust the locomotive performance, such as to insure that the train has sufficient speed as it approaches a hill and/or tunnel. For example, this could be expressed as a speed constraint at a particular location that becomes part of the optimal plan generation created solving the equation (OP). Additionally, embodiments of the present invention may incorporate train-handling rules, such as, but not limited to, tractive effort ramp rates, and maximum braking effort ramp rates. These may be incorporated directly into the formulation for optimum trip profile or alternatively incorporated into the closed loop regulator used to control power application to achieve the target speed.

In one embodiment, the trip planner system of the present invention is only installed on a lead locomotive of the train consist. Even though the system is not dependant on data or interactions with other locomotives, it may be integrated with a consist manager, as disclosed in U.S. Pat. No. 6,691,957 and U.S. Pat. No. 7,021,588 (owned by the Assignee and both incorporated by reference), functionality and/or a consist optimizer functionality to improve efficiency. Interaction with multiple trains is not precluded, as illustrated by the example of dispatch arbitrating two "independently optimized" trains described herein.

Trains with distributed power systems can be operated in different modes. One mode is where all locomotives in the train operate at the same notch command. So if the lead locomotive is commanding motoring—N8, all units in the train will be commanded to generate motoring—N8 power. Another mode of operation is "independent" control. In this mode, locomotives or sets of locomotives distributed throughout the train can be operated at different motoring or braking powers. For example, as a train crests a mountaintop, the lead locomotives (on the down slope of mountain) may be placed in braking, while the locomotives in the middle or at the end of the train (on the up slope of mountain) may be in motoring. This is done to minimize tensile forces on the mechanical couplers that connect the railcars and locomotives. Traditionally, operating the distributed power system in "independent" mode required the operator to manually command each remote locomotive or set of locomotives via a display in the lead locomotive. Using the physics based planning model, train set-up information, on-board track database, on-board operating rules, location determination system, real-time closed loop power/brake control, and sensor feedback, the system is able to automatically operate the distributed power system in "independent" mode.

When operating in distributed power, the operator in a lead locomotive can control operating functions of remote locomotives in the remote consists via a control system, such as a distributed power control element. Thus when operating in distributed power, the operator can command each locomotive consist to operate at a different notch power level (or one consist could be in motoring and another could be in braking), wherein each individual locomotive in the locomotive consist operates at the same notch power. In an exemplary embodiment, with the trip planner system installed on the train, and typically in communication with the distributed power control element, when a notch power level for a remote locomotive consist is desired as recommended by the optimized trip plan, the system will communicate this power setting to the remote locomotive consists for implementation. As discussed below, the same is true regarding braking.

Embodiments of the present invention may be used with consists in which the locomotives are not contiguous, e.g., with 1 or more locomotives up front and others in the middle and/or at the rear for train. Such configurations are called distributed power, wherein the standard connection between the locomotives is replaced by radio link or auxiliary cable to link the locomotives externally. When operating in distributed power, the operator in a lead locomotive can control operating functions of remote locomotives in the consist via a control system, such as a distributed power control element. In particular, when operating in distributed power, the operator can command each locomotive consist to operate at a different notch power level (or one consist could be in motoring and other could be in braking) wherein each individual in the locomotive consist operates at the same notch power.

In an exemplary embodiment, with the trip planner system installed on the train, and typically in communication with the distributed power control element, when a notch power level for a remote locomotive consist is desired as recommended by the optimized trip plan, the present invention will communicate this power setting to the remote locomotive consists for implementation. As discussed below, the same is true regarding braking. When operating with distributed power, the optimization problem previously described can be enhanced to allow additional degrees of freedom, in that each of the remote units can be independently controlled from the lead unit. The value of this is that additional objectives or constraints relating to in-train forces may be incorporated into the performance function, assuming the model to reflect the in-train forces is also included. Thus, embodiments of the present invention may include the use of multiple throttle controls to better manage in-train forces as well as fuel consumption and emissions.

In a train utilizing a consist manager, the lead locomotive in a locomotive consist may operate at a different notch power setting than other locomotives in that consist. The other locomotives in the consist operate at the same notch power setting. Embodiments of the present invention may be utilized in conjunction with the consist manager to command notch power settings for the locomotives in the consist. Thus, based on exemplary embodiments of the present invention, since the consist manager divides a locomotive consist into two groups, namely, lead locomotive and trail units, the lead locomotive will be commanded to operate at a certain notch power and the trail locomotives are commanded to operate at another certain notch power. In an exemplary embodiment, the distributed power control element may be the system and/or apparatus where this operation is housed.

Likewise, when a consist optimizer is used with a locomotive consist, the present invention can be used in conjunction with the consist optimizer to determine notch power for each locomotive in the locomotive consist. For example, suppose that a trip plan recommends a notch power setting of 4 for the locomotive consist. Based on the location of the train, the consist optimizer will take this information and then determine the notch power setting for each locomotive in the consist. In this implementation, the efficiency of setting notch power settings over intra-train communication channels is improved. Furthermore, as discussed above, implementation of this configuration may be performed utilizing the distributed control system.

Furthermore, as discussed previously, exemplary embodiments of the present invention may be used for continuous corrections and re-planning with respect to when the train consist uses braking based on upcoming items of interest, such as but not limited to, railroad crossings, grade changes, approaching sidings, approaching depot yards, and approaching fuel stations where each locomotive in the consist may require a different braking option. For example, if the train is coming over a hill, the lead locomotive may have to enter a braking condition whereas the remote locomotives, having not reached the peak of the hill may have to remain in a motoring state.

Figure 8:
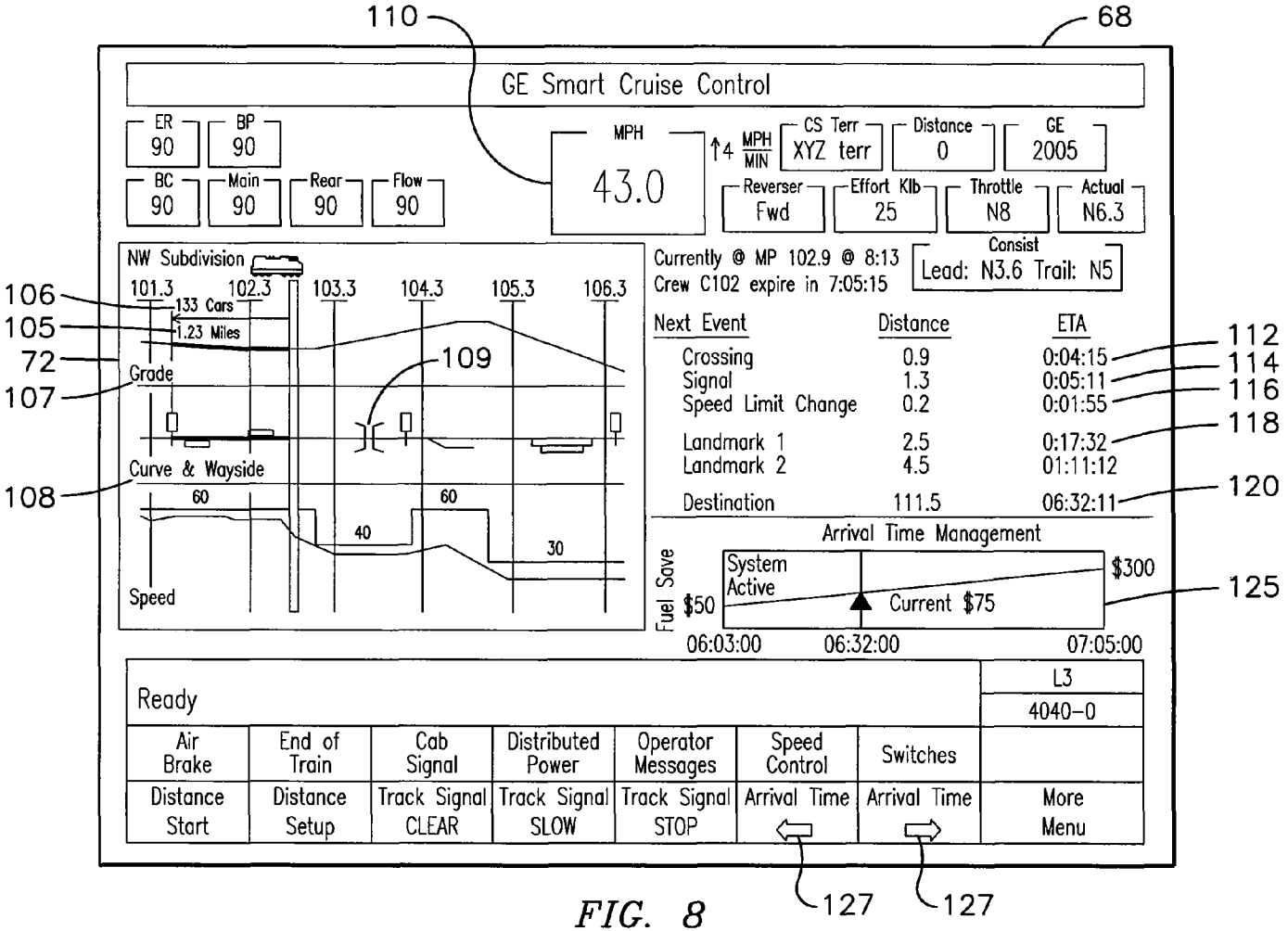
FIG. 8 depicts an exemplary illustration of a dynamic display for use by the operator.
Figure 9:
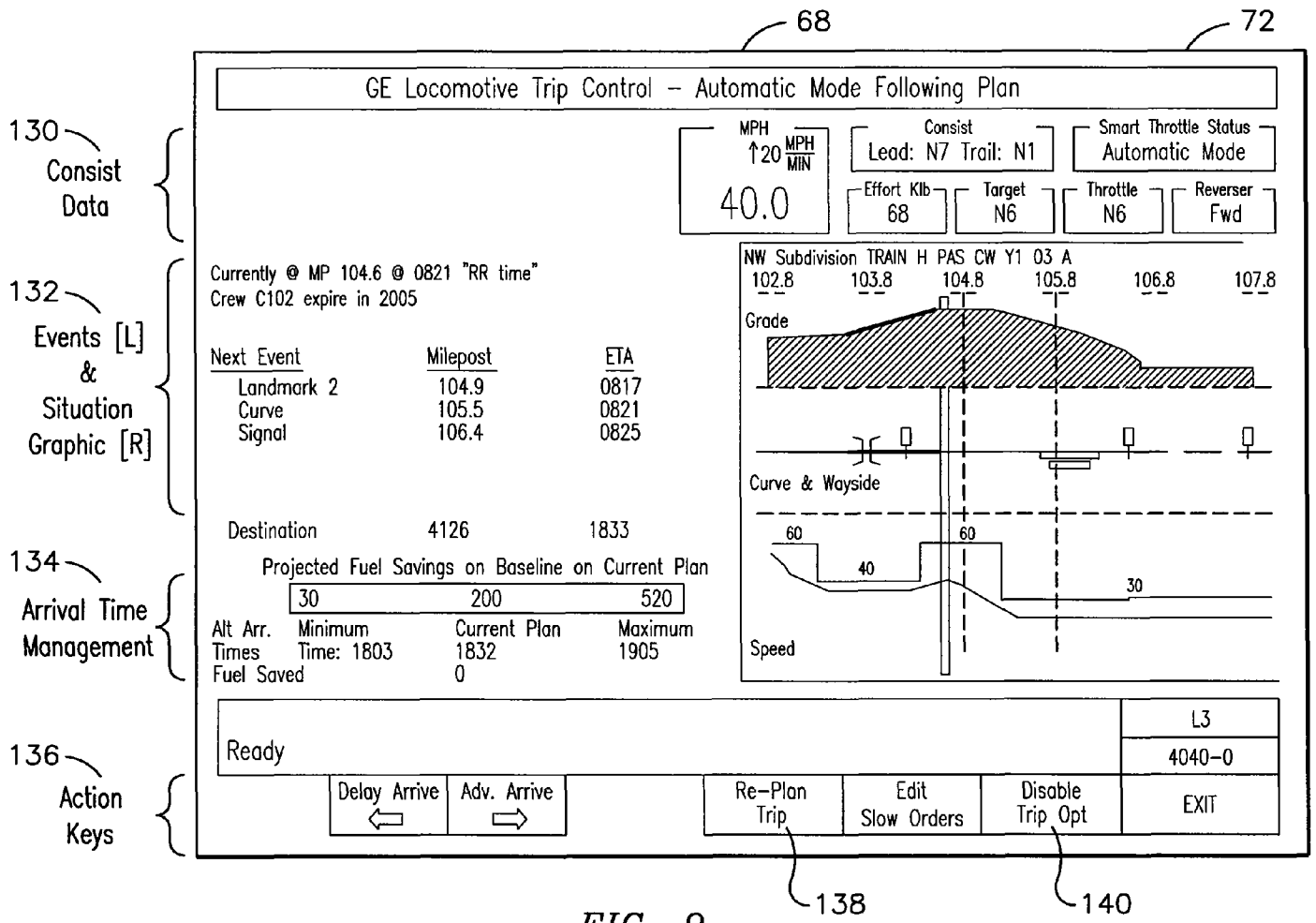
FIG. 9 depicts another exemplary illustration of a dynamic display for use by the operator.
Figure 10:
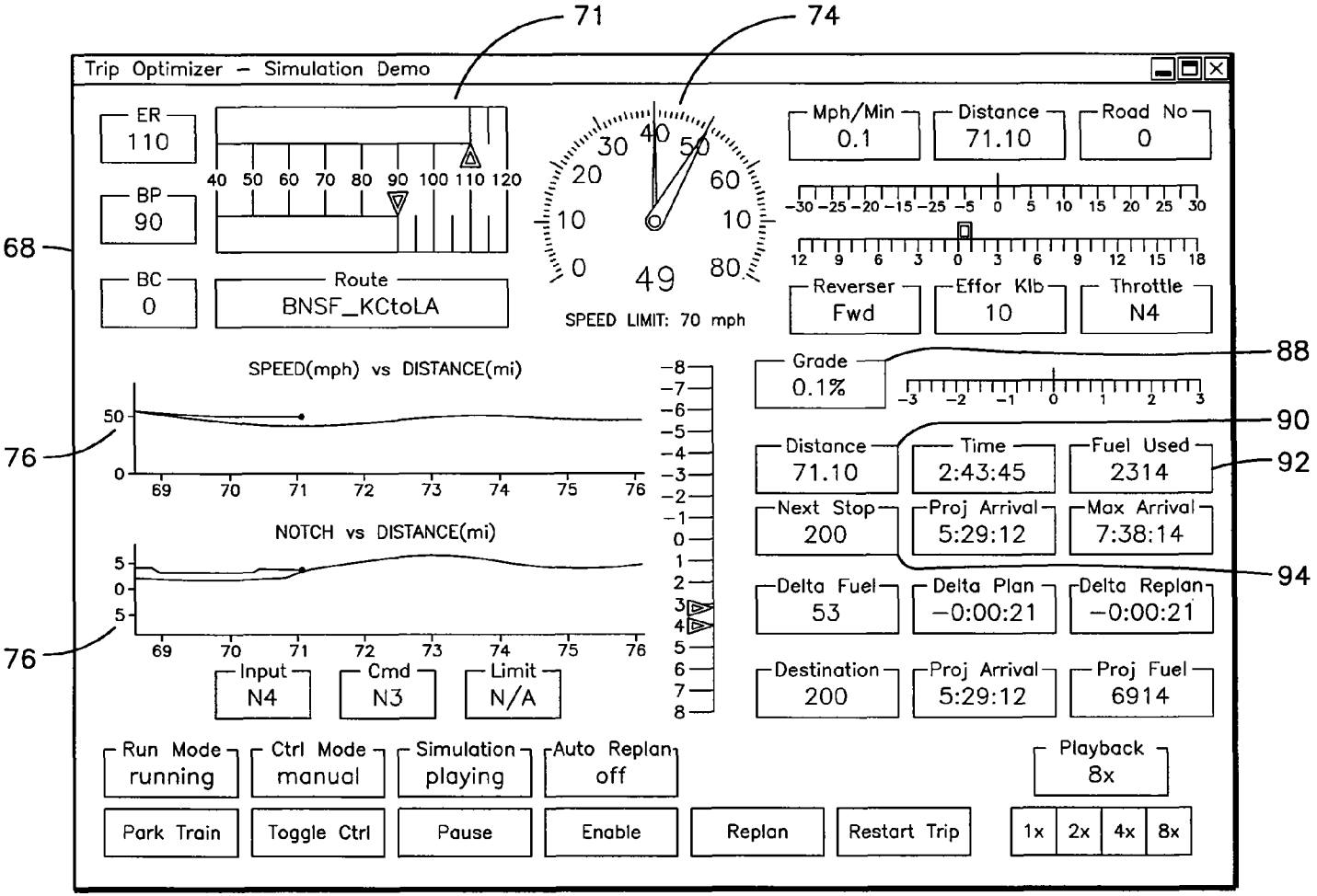
FIG. 10 depicts another exemplary illustration of a dynamic display for use by the operator.

FIGS. 8, 9, and 10 depict exemplary illustrations of dynamic displays 68 for use by the operator. As shown in FIG. 8, a trip profile 72 is provided in the form of a rolling map. Within the profile a location 73 of the locomotive is provided. Such information as train length 105 and the number of cars 106 in the train is also provided. Display elements are also provided regarding track grade 107, curve and wayside elements 108, including bridge location 109, and train speed 110. The display 68 allows the operator to view such information and also see where the train is along the route. Information pertaining to distance and/or estimate time of arrival to such locations as crossings 112, signals 114, speed changes 116, landmarks 118, and destinations 120 is provided. An arrival time management tool 125 is also provided to allow the user to determine the fuel savings that is being realized during the trip. The operator has the ability to vary arrival times 127 and witness how this affects the fuel savings. As discussed herein, those skilled in the art will recognize that fuel saving is an exemplary example of only one objective that can be reviewed with a management tool. Towards this end, depending on the parameter being viewed, other parameters discussed herein can be viewed and evaluated with a management tool that is visible to the operator. The operator is also provided information about how long the crew has been operating the train. In exemplary embodiments time and distance information may either be illustrated as the time and/or distance until a particular event and/or location, or it may provide a total elapsed time.

As illustrated in FIG. 9, an exemplary display 68 provides information about consist data 130, an events and situation graphic 132, an arrival time management tool 134, and action keys 136. Similar information as discussed above is provided in this display as well. This display 68 also provides action keys 138 to allow the operator to re-plan as well as to disengage 140 the trip planner optimization system.

FIG. 10 depicts another exemplary embodiment of the display. Data typical of a modern locomotive including air-brake status 71, analog speedometer with digital insert, or indicator, 74, and information about tractive effort in pounds force (or traction amps for DC locomotives) is visible. An indicator 74 is provided to show the current optimal speed in the plan being executed, as well as an accelerometer graphic to supplement the readout in mph/minute. Important new data for optimal plan execution is in the center of the screen, including a rolling strip graphic 76 with optimal speed and notch setting versus distance compared to the current history of these variables. In this exemplary embodiment, the location of the train is derived using the locator element. As illustrated, the location is provided by identifying how far the train is away from its final destination, an absolute position, an initial destination, an intermediate point, and/or an operator input.

The strip chart provides a look-ahead to changes in speed required to follow the optimal plan, which is useful in manual control, and monitors plan versus actual during automatic control. As discussed herein, such as when in the coaching mode, the operator can follow either the notch or speed suggested by the trip planner system. The vertical bar gives a graphic of desired and actual notch, which are also displayed digitally below the strip chart. When continuous notch power is utilized, as discussed above, the display will simply round to the closest discrete equivalent. The display may be an analog display so that an analog equivalent or a percentage or actual horse power/tractive effort is displayed.

Critical information on trip status is displayed on the screen, and shows the current grade the train is encountering 88, either by the lead locomotive, a location elsewhere along the train or an average over the train length. A distance traveled so far in the plan 90, cumulative fuel used 92, where the next stop is planned 94 (or a distance there from), current and projected arrival time 96, and expected time to be at next stop are also disclosed. The display 68 also shows the maximum possible time to destination possible with the computed plans available. If a later arrival was required, a re-plan would be carried out. Delta plan data shows status for fuel and schedule ahead or behind the current optimal plan. Negative numbers mean less fuel or early compared to plan, positive numbers mean more fuel or late compared to plan, and typically trade-off in opposite directions (slowing down to save fuel makes the train late and conversely).

At all times, these displays 68 give the operator a snapshot of where he stands with respect to the currently instituted driving plan. This display is for illustrative purpose only as there are many other ways of displaying/conveying this information to the operator and/or dispatch. Towards this end, the information disclosed above could be intermixed to provide a display different than the ones disclosed.

Another feature that may be included in the trip planner system is allowing for the generating of data logs and reports. This information may be stored on the train and downloaded to an off-board system at some point in time. The downloads may occur via manual and/or wireless transmission. This information may also be viewable by the operator via the locomotive display. The data may include such information as, but not limited to, operator inputs, time system is operational, fuel saved, fuel imbalance across locomotives in the train, train journey off course, system diagnostic issues such as if a GPS sensor is malfunctioning.

Since trip plans must also take into consideration allowable crew operation time, the system of the present invention may take such information into consideration as a trip is planned. For example, if the maximum time a crew may operate is eight hours, then the trip shall be fashioned to include stopping location for a new crew to take the place of the present crew. Such specified stopping locations may include, but are not limited to rail yards, meet/pass locations, etc. If, as the trip progresses, the trip time may be exceeded, the trip optimization system may be overridden by the operator to meet criteria as determined by the operator. Ultimately, regardless of the operating conditions of the train, such as but not limited to high load, low speed, train stretch conditions, etc., the operator remains in control to command a speed and/or operating condition of the train.

Using the trip optimization system, the train may operate in a plurality of manners. In one operational concept, the system may provide commands for commanding propulsion and dynamic braking. The operator then handles all other train functions. In another operational concept, the system may provide commands for commanding propulsion only. The operator then handles dynamic braking and all other train functions. In yet another operational concept, the system may provide commands for commanding propulsion, dynamic braking, and application of the airbrake. The operator then handles all other train functions.

The trip optimizer system may also be configured to notify the operator of upcoming items of interest or actions to be taken. Specifically, using forecasting logic as described above, the continuous corrections and re-planning to the optimized trip plan, and/or the track database, the operator can be notified of upcoming crossings, signals, grade changes, brake actions, sidings, rail yards, fuel stations, etc. This notification may occur audibly and/or through the operator interface.

Specifically, using the physics based planning model, train set-up information, on-board track database, on-board operating rules, location determination system, real-time closed loop power/brake control, and sensor feedback, the system presents and/or notifies the operator of required actions. The notification can be visual and/or audible. Examples include notifying of crossings that require the operator to activate the locomotive horn and/or bell, and notifying of "silent" crossings that do not require the operator activate the locomotive horn or bell.

In another exemplary embodiment, using the physics based planning model discussed above, train set-up information, on-board track database, on-board operating rules, location determination system, real-time closed power/brake control, and sensor feedback, the system may present the operator information (e.g., a gauge on display) that allows the operator to see when the train will arrive at various locations, as illustrated in FIG. 9. The system allows the operator to adjust the trip plan (e.g., target arrival time). This information (actual estimated arrival time or information needed to derive off-board) can also be communicated to the dispatch center to allow the dispatcher or dispatch system to adjust the target arrival times. This allows the system to quickly adjust and optimize for the appropriate target function (for example trading off speed and fuel usage).

In one example involving marine vessels, a plurality of tugs may be operating together where all are moving the same larger vessel, where each tug is linked in time to accomplish the mission of moving the larger vessel. In another example a single marine vessel may have a plurality of engines. Off-Highway Vehicle (OHV) applications may involve a fleet of vehicles that have a same mission to move earth, from location A to location B, where each OHV is linked in time to accomplish the mission. With respect to a stationary power generating station, a plurality of stations may be grouped together for collectively generating power for a specific location and/or purpose. In another exemplary embodiment, a single station is provided, but with a plurality of generators making up the single station. In one example involving locomotive vehicles, a plurality of diesel powered systems may be operated together where all are moving the same larger load, where each system is linked in time to accomplish the mission of moving the larger load. In another exemplary embodiment a locomotive vehicle may have more than one diesel powered system.

Figure 11:
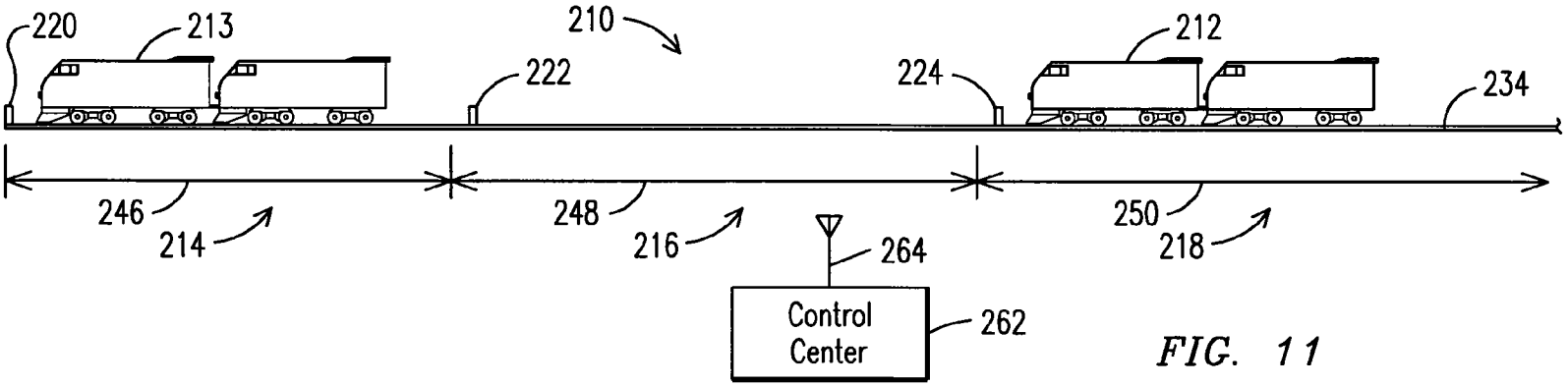
FIG. 11 illustrates a side plan view of an exemplary embodiment of a system for pacing a powered system traveling along a route separated into a plurality of block regions in accordance with the present invention.

FIG. 11 illustrates an exemplary embodiment of a system 210 for pacing a powered system (e.g., controlling the velocity or other rate of operation of the powered system, or otherwise controlling the pace of the powered system) such as a locomotive 212 traveling along a route such a railroad 234 separated into block regions 214,216,218. A leading locomotive 213 is also traveling along the railroad 234, and is positioned ahead of the locomotive 212. Each block region 214, 216,218 has a respective light signal 220,222,224, which indicates a status to a locomotive in the respective block region 214,216,218 or approaching the respective block region. The status of the light signal 220 would depend on whether a locomotive occupied one of the next two block regions following the block region 214. For example, if a locomotive occupied the first block region after the block region 214, the light signal 220 would be red. In another example, if a locomotive occupied the second block region after the block region 214, the light signal 220 would be yellow. In the example illustrated in FIG. 11, the status of the light signal 222 is red, since the leading locomotive 213 occupies the block region 214 after the block region 216, and would instruct the operator of a locomotive in the block region 216 to stop. The status of the light signal 224 is yellow, since the leading locomotive 213 occupies the block region 214 which is two block regions ahead of the block region 218, and would instruct the operator of the locomotive 212 to slow down. A control center 262 is positioned remotely to the railroad 234 and is configured to transmit the status of the signals 220,222,224 using a transceiver 264 to the locomotive 212, so that a controller 226 (FIG. 12) can utilize this status information of the signals 220,222,224 in the operation of the locomotive 212. Additionally, the status of the signals 220, 222,224 may be transmitted to the locomotive 212 from the signals 220,222,224 themselves or may be manually inputted into the controller 226 by the operator, for example.

Figure 12:
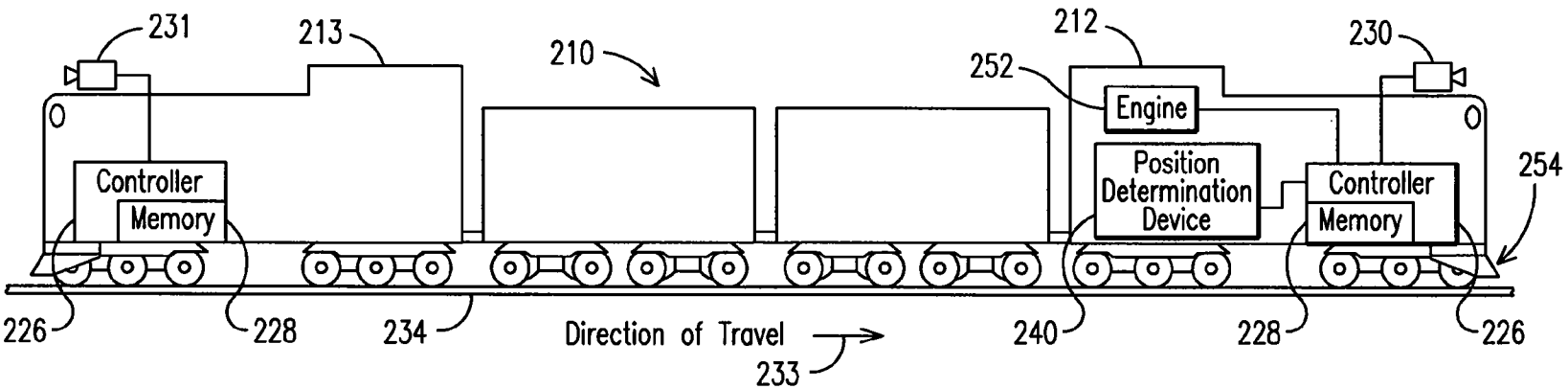
FIG. 12 illustrates a side plan view of an exemplary embodiment of a system for pacing a powered system traveling along a route separated into a plurality of block regions in accordance with the present invention.
Figure 13:
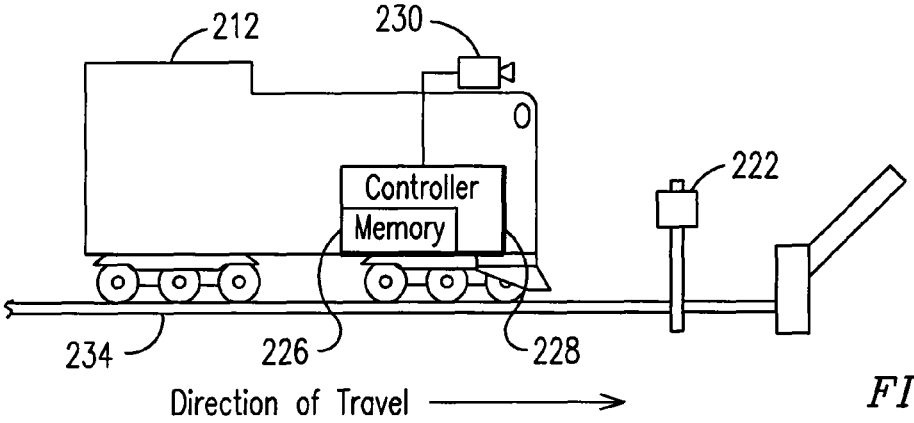
FIG. 13 illustrates a partial side plan view of the exemplary embodiment of a system for pacing a powered system traveling along a route separated into a plurality of block regions illustrated in FIG. 12.

As illustrated in the exemplary embodiment of FIG. 12, the system 210 includes a controller 226 positioned on the locomotive 212. The controller 226 includes a memory 228, which stores a parameter of the railroad 234 along each of the block regions 214,216,218, such as a respective length 246, 248,250 (FIG. 11) of the block regions 214,216,218, or a grade of the block regions 214,216,218, for example. Additionally, a pair of video cameras 230,231 are positioned on the locomotive 212, and are respectively oriented in the same and opposite as the direction of travel 233. The pair of video cameras 230,231 are respectively coupled to the controller 226. The forward-oriented camera 230 is positioned and/or aligned to monitor the status of the signals 220,222 in adjacent block regions 214,216 ahead of the current block region 218 of the locomotive 212. Additionally, the rearward-oriented camera 231 may be positioned and/or aligned to monitor the status of the signals (not shown) in adjacent block regions (not shown) behind the current block region 218. Although FIG. 12 illustrates a locomotive 212 having a forward and rearward oriented camera 230,231, the locomotive may only have a forward oriented camera 230, or may have no cameras, in which case an operator of the locomotive 212 monitors the status of the signals 220,222 in adjacent block regions 214,216 ahead of the current block region 218 of the locomotive 212. Upon monitoring the status of these signals 220,222, the operator inputs the status of the signals 220,222 into the controller 226 using a keypad. Additionally, as discussed above, the control center 262 may transmit the status of one or more of the signals 220,222,224 to the controller 226 through the transceiver 264 of the control center 262.

Upon receiving the status of the signals 220,222 of the adjacent block regions 214,216 ahead of the current block region 218, the controller 226 measures a time duration between a change in the status of a signal 220,222 in an adjacent block region 214,216. For example, once the leading locomotive 213 enters the adjacent block region 214, the signal 222 will change its status from a green status to a red status. Additionally, once the leading locomotive 213 leaves the adjacent block region 214, the signal 222 will change its status from a red status to a yellow status. Thus, the controller 226 will receive these changes in status of the signal 222 as the leading locomotive 213 respectively enters and exits the adjacent block region 214. The controller 214 subsequently determines the time duration between the initial change in status of the signal 222, when the leading locomotive 213 entered the adjacent block region 214, and the subsequent change in status of the signal 222, when the leading locomotive 213 exited the adjacent block region 214. Therefore, the controller knows the amount of time required for train 213 to traverse the block 214. In another example, the controller 226 may determine the time duration between the change in the status of the signal 222 from a green status to a red status, when the leading locomotive 213 enters the adjacent block region 213 and the change in the status of the signal 220 from a green status to a red status, when the leading locomotive 213 exits the adjacent block region 213.

As illustrated in FIG. 12, the system 210 further includes a position determination device 240 on the locomotive 212 to provide location information of the locomotive 212 along the railroad 234 to the controller 226. Upon calculating the time duration required from the leading locomotive 213 to pass through the adjacent block region 214, the controller 226 determines an estimated speed of the leading locomotive 213 through the adjacent block region 214, based on the time duration and a length 246 of the adjacent block region 214 from the memory 228. Additionally, the controller 226 may utilize a stored parameter of the railroad 234 from the memory 228, such as the grade of the railroad 234 through the adjacent block region 214, for example, in calculating the estimate speed.

In an exemplary embodiment, the controller 226 determines a characteristic of the leading locomotive 213, such as the type of locomotive, the weight, or the length, for example, based upon the estimated speed of the leading locomotive 213 in the adjacent block region 214. The memory 228 of the controller 226 may have a pre-stored table with the typical characteristics for a locomotive based upon a typical speed, for example, and the controller 226 may determine the characteristics of the leading locomotive 213 from the memory 228 based on the estimated speed through the adjacent block region 214, for example. Once the controller 226 has determined the characteristics of the leading locomotive 213, the controller 226 determines an expected movement of the leading locomotive 213 through the block regions subsequent to the adjacent block region 214, based on the characteristics of the leading locomotive 213, and the pre-stored parameters of the block regions, including length and grade, for example, from the memory 228, for example. For example, if the controller 226 estimates a speed of 20 mph of the leading locomotive 213 through the adjacent block region 214, and determines that the characteristics of the leading locomotive 213 are similar to a coal train, the controller 226 may determine that the leading locomotive 213 will travel through the next three block regions in 30 minutes, 20 minutes, and 1 hour, respectively, based on the length and grade of those block regions stored in the memory 228, for example.

In an exemplary embodiment, upon determining the expected movement of the leading locomotive 213 through the block regions subsequent to the adjacent block region 214, the controller 226 determines an expected status of the signals to be experienced by the locomotive 212 in these respective block regions. In the example above where the system determines that the leading locomotive 213 will travel through the next three block regions in 30 minutes, 20 minutes and 1 hour, respectively, the controller 226 determines that the signal 220 will not change from red to yellow for the 30 minutes after the leading locomotive 213 enters the first block region after the adjacent block region 214. Additionally, the controller 226 will determine that the first signal after the signal 220 will not change from red to yellow for 1 hour and 50 minutes after the leading locomotive 213 enters the first block region after the adjacent block region 214.

As illustrated in FIG. 12, the controller 226 is coupled to an engine 252 and a braking system 254 of the locomotive 212. The controller 226 selectively modifies a notch of the engine 252 and/or selectively activates the braking system 254, based on the expected status of the signals in block regions after the adjacent block region 214, so as to minimize a total amount of fuel consumed by the locomotive 212 in the block regions. In the above example, since the first signal after the signal 220 will not change from red to yellow for 1 hour and 50 minutes after the leading locomotive 213 enters the first block region after the adjacent block region 214, the controller 226 may modify the engine 252 notch to zero, instead of activating the brakes, and coast through the adjacent block region 214 to conserve fuel.

In an exemplary embodiment, the controller 226 is in an automatic mode and prior to commencing the trip on the railroad 234, determines a predetermined notch of the engine 252 and/or a predetermined level of the braking system 254 (and/or other predetermined operating parameter) at incremental locations along the railroad 234. Based on the expected status of the signals in the block regions after the adjacent block region 214, the controller 226 may modify the predetermined notch of the engine 252 and/or the predetermined level of the braking system 254 at the incremental locations along the railroad 234.

Figure 14:
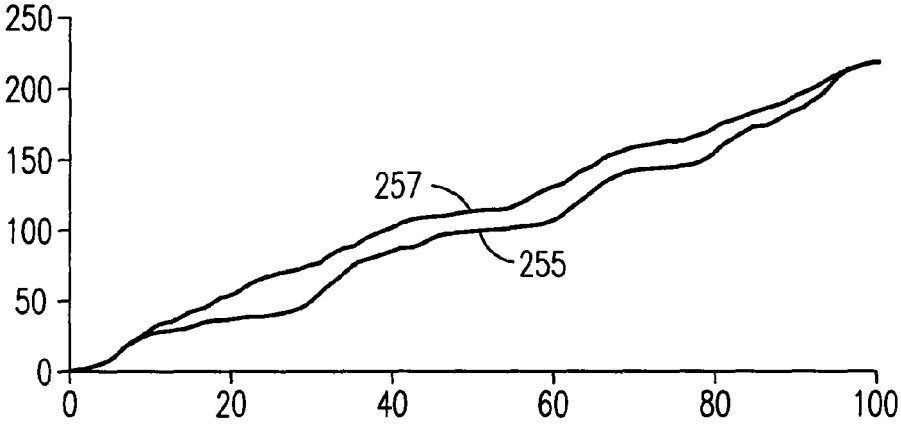
FIG. 14 illustrates a plot of an exemplary embodiment of the conventional plan and a modified plan of the projected time versus distance of a locomotive traveling along a route.
Figure 15:
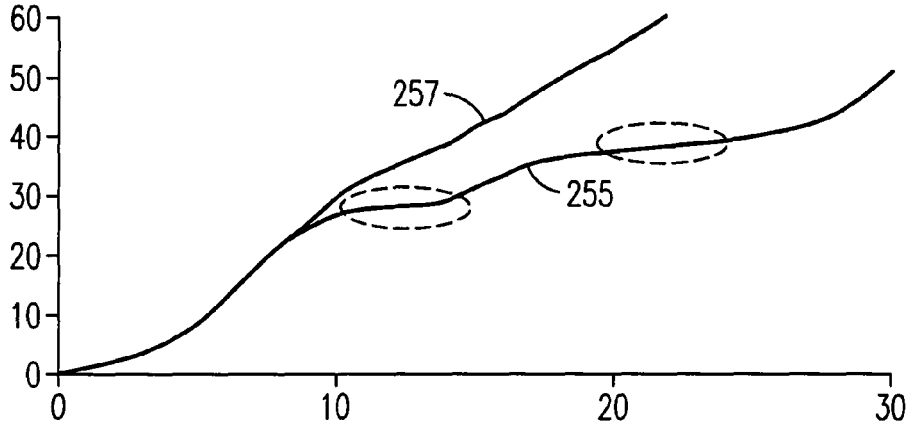
FIG. 15 illustrates a partial plot of an exemplary embodiment of the modified plan illustrated in FIG. 14.

FIG. 14 illustrates an exemplary plot of the distance in miles (horizontal axis) versus the time in minutes (vertical axis) of the locomotive 212 while traveling through the block regions over the railroad 234. Based on the expected status of the signals in the block regions after the adjacent block region 214, the controller 226 determined to modify the original plan 255 to a modified plan 257 in which the controller 226 reduced the notch of the engine 252 and/or activated the braking system 254 before reaching the mile markers 13, 20, 50 and 75. For example, the controller 226 may have determined that a signal positioned at mile markers 13, 20, 50 and 75 would have a red or a yellow status under the original plan 255, but would each have a green status under the modified plan 257. In the exemplary embodiment of FIG. 15, which illustrates a more-detailed view of FIG. 14 from the mile markers 0-30, the original plan 255 involved a relatively high speed to mile markers 13 and 20, followed by a sharp reduction in speed. The modified plan 257, conversely, involves a consistent locomotive 212 speed throughout the mile markers 0-30, resulting in increased fuel efficiency, for example.

Figure 16:
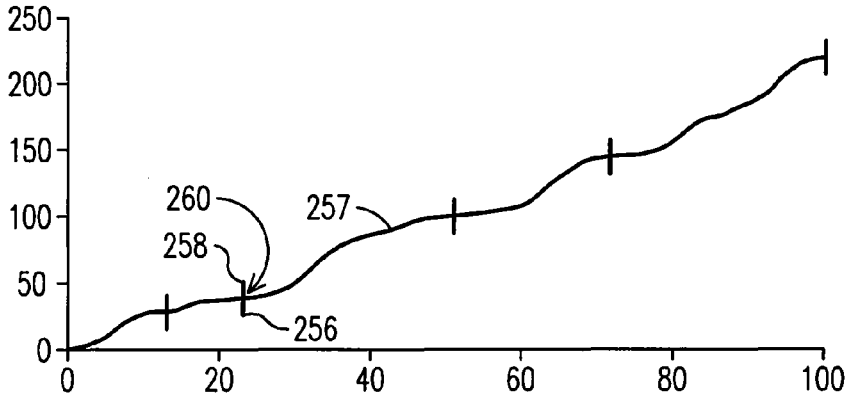
FIG. 16 illustrates a plot of an exemplary embodiment of a modified plan of a projected time versus distance of a locomotive traveling along a route.

As illustrated in the exemplary embodiment of FIG. 16, the controller 226 may determine an earliest arrival time 256 and a latest arrival time 258 at each block region, which is based upon the expected status of the signal in the block regions. The earliest arrival time at a block region is determined to avoid blocking the railroad 234 from following locomotives, while the latest arrival time at a block region is determined to avoid running into or colliding with the leading locomotive 213. The controller 226 may selectively modify the notch of the engine 252 and/or the braking system 254 such that the locomotive 212 arrives at each block region within an arrival time range 260 defined by the earliest arrival time 256 and the latest arrival time 258. In an exemplary embodiment, the earliest arrival time 256 for a block region may be based on a change in the status of the signal in the block region from red to yellow, for example. In another exemplary embodiment, the latest arrival time 258 for a block region may be based on a change in the status of the signal in two preceding blocks and the position of a trailing locomotive, for example.

In the above exemplary embodiment, the controller 226 determined a characteristic of the leading locomotive 213 by estimating a speed of the locomotive through an adjacent block region 214. However, other methods may be employed by the system 210 to determine a characteristic of the leading locomotive 213 and subsequently determine an expected status of the signals within block regions along the railroad 234. The memory 228 may have pre-stored characteristics of the leading locomotive 213 that travels on the railroad 234 in the adjacent block region 214. The controller 226 determines an expected movement of the leading locomotive 213 in subsequent block regions to the adjacent block region 214 based upon the pre-stored leading locomotive 213 characteristic and/or the route parameter of the subsequent block regions. The controller 226 determines the expected status of the signal to be experienced by the locomotive 212 in the block regions, based on the expected movement of the leading locomotive 213 in the subsequent block regions.

Figure 17:
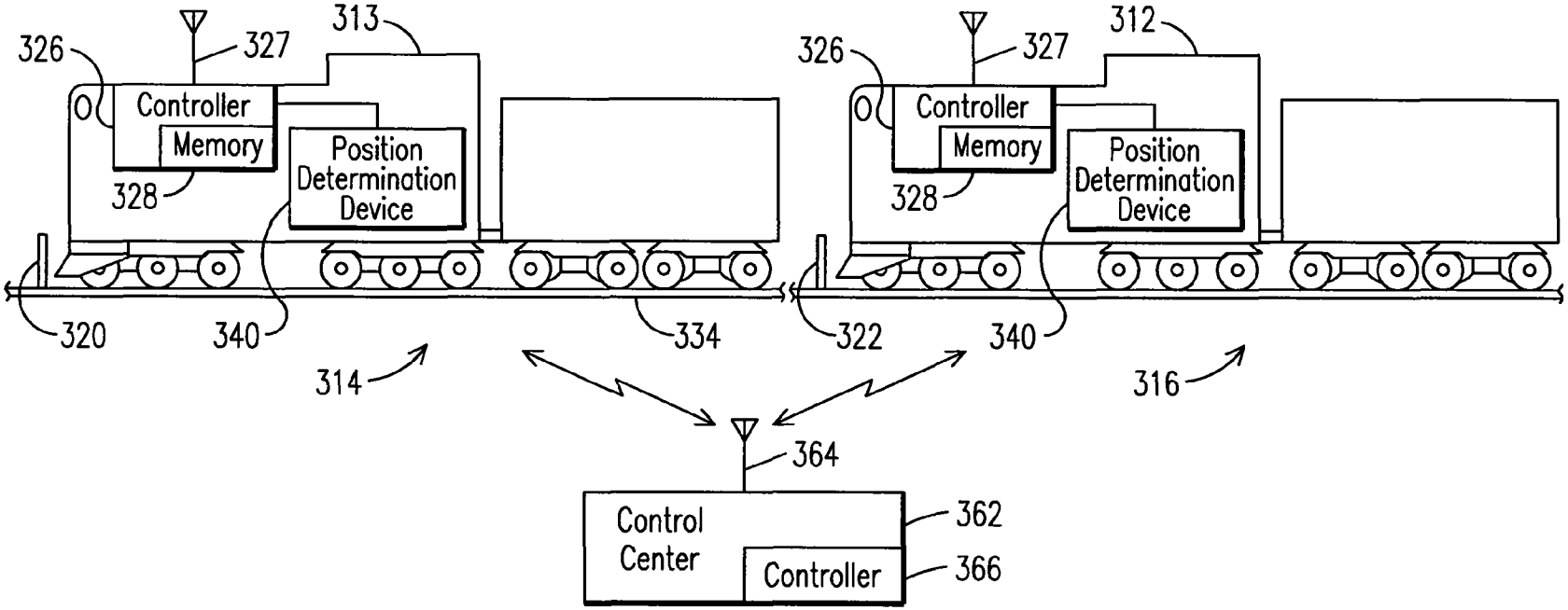
FIG. 17 illustrates a side plan view of an exemplary embodiment of a system for pacing a powered system traveling along a route separated into a plurality of block regions in accordance with the present invention.

FIG. 17 illustrates an exemplary embodiment of a system 310 for pacing a pair of locomotives 312,313 traveling along a railroad 334 separated into block regions 314, 316. Although FIG. 17 illustrates a pair of locomotives 312,313, the system 310 may be implemented with a single locomotive or more than two locomotives, for example. Each block region 314,316 has a respective signal 320, 322. The system 310 includes a control center 362 positioned remotely from the railroad 334. The control center 362 has a transceiver 364 in communication with a respective transceiver 327 coupled to the locomotives 312,313 or to the track or the track signaling system.

Figure 18:
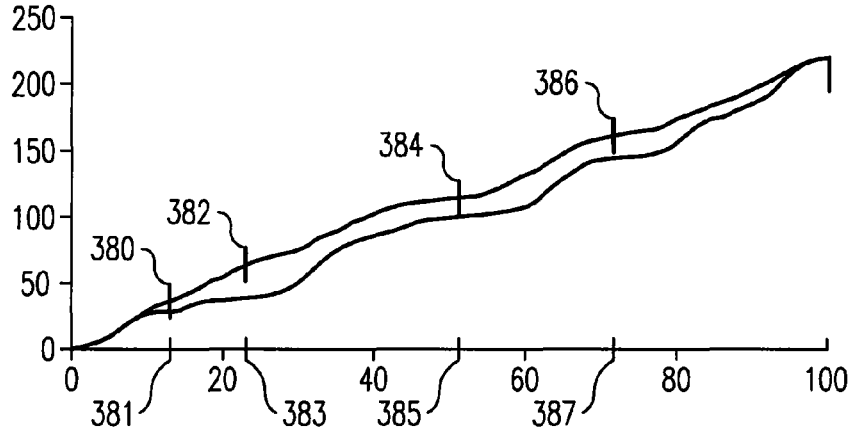
FIG. 18 illustrates a plot of an exemplary embodiment of a modified plan of a projected time versus distance of a locomotive traveling along a route.

The locomotives 312,313 each include a controller 326 coupled to the transceiver 327. As shown in FIG. 18, the controller 326 of each locomotive 312,313 receives an arrival time range 380,382 for a plurality of block regions 385, 387 (at approximately mile post 50 and 70) along the railroad 334 from the transceiver 364. Thus, as long as the locomotive 312 arrives at the block region 385 within the time range 380, and arrives at the block region 387 within the time range 382, the locomotive 312 will experience one of many performance advantages, such as a minimal amount of fuel consumed, a minimum amount of energy consumed, or a consistent status of green signals through the block regions 385, 387, for example. In the exemplary embodiment of FIG. 18, the arrival time range 384 for the locomotive 312 to travel through the block region 385 is approximately 100-120 minutes from the commencement of the trip, and thus the locomotive 312 would need to arrive at the block region 385 in that time range in order to take advantage of a performance advantage listed above, for example. Additionally, in this example, if the locomotive 312 were to arrive at the block region 385 just prior to 100 minutes from the commencement of the trip (i.e., at the earliest arrival time), the signal in the block region 385 may have a yellow status, but if the locomotive 312 were to arrive at the block region 385 shortly after 100 minutes (e.g., 110 minutes) from the commencement of the trip, the signal in the block region 385 would have a green status, for example. The controller 326 has a memory 328 to store a parameter of the locomotive 312,313 and a parameter of the route 334. The locomotives 312,313 each further include a position determination device 340 to provide location information of the locomotive 312,313 to the controller 326. The locomotives 312, 313 respectively transmit the pre-stored locomotive parameter, the pre-stored railroad 334 parameter, and the location information to the control center 362. The control center 362 utilizes the locomotive parameter, railroad parameter and location information from the locomotive 312 to determine an estimated arrival time of the locomotive 312 at the block regions 385,387. The control center 362 includes a controller 366 to determine the arrival time ranges 380,382 for the plurality of block regions 381,383 along the railroad 334 such that the locomotives 312,313 collectively consume a minimal amount of fuel while traveling along the route. As illustrated in the exemplary embodiment of FIG. 18, the controller 326 of the locomotive 312 may determine an arrival time range 380,382 at a pair of block regions 381,383 (at approximately mile post 15 and 25), using the local pacing methods discussed in the above embodiments of FIGS. 11-16, based on determining an expected status of signals within the pair of block regions 381,383 by estimating the characteristics of a leading locomotive. Thus, the system 310 may involve an arrival time range 380,382 for some block regions 381,383 determined by the local pacing methods of FIGS. 11-16 and an arrival time ranges 384,386 provided by the control center 362 for other block regions 385,387, such that the controller 326 can plan accordingly in order to minimize the total amount of fuel consumed and/or the total amount of energy consumed, for example. The arrival time windows could be multiple (for red/flashing yellow/yellow/green status) or could be both time and speed to traverse thru a block region.

Figure 19:
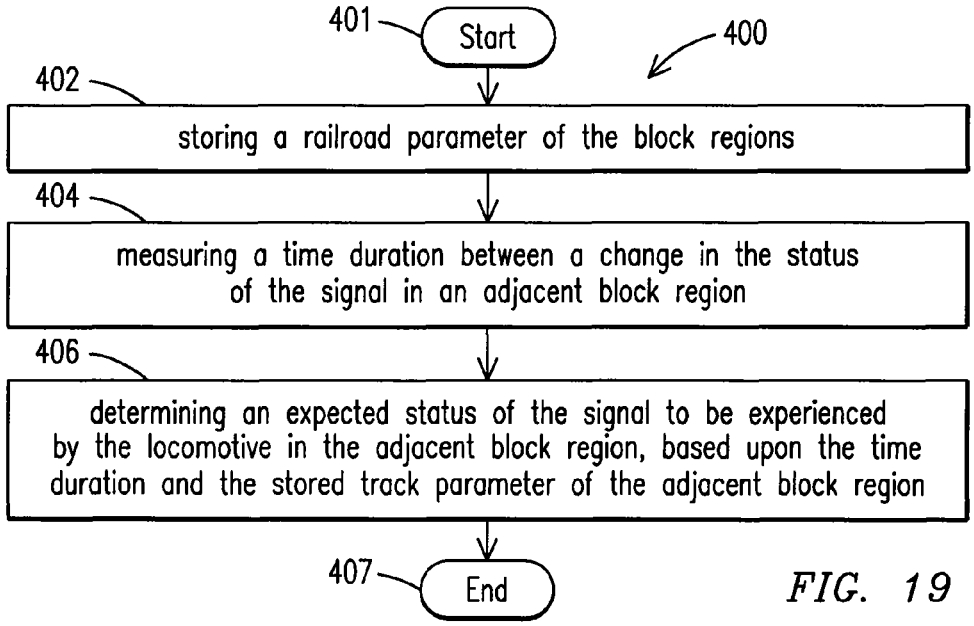
FIG. 19 illustrates a flow chart of an exemplary embodiment of a method for pacing a powered system traveling along a route separated into a plurality of block regions in accordance with the present invention.

FIG. 19 illustrates an exemplary embodiment of a method 400 for pacing a locomotive 212 traveling along a railroad 234 separated into a plurality of block regions 214,216,218. Each block region 214,216,218 has a respective signal 220, 222,224. The method 400 begins at 401 by storing 402 a railroad 234 parameter of the block regions 214,216,218. The method 400 further includes measuring 404 a time duration between a change in the status of the signal 222 in an adjacent block region 216 to a current block region 218 of the locomotive 212. The method 400 further includes determining 406 an expected status of the signal to be experienced by the locomotive 212 in the adjacent block region, based upon the time duration and the stored track parameter of the adjacent block region, before ending at 407.

Though exemplary embodiments of the present invention are described with respect to rail vehicles, or railway transportation systems, specifically trains and locomotives having diesel engines, exemplary embodiments of the invention are also applicable for other uses, such as but not limited to off-highway vehicles, marine vessels, stationary units, and, agricultural vehicles, transport buses, each which may use at least one diesel engine, or diesel internal combustion engine. Towards this end, when discussing a specified mission, this includes a task or requirement to be performed by the powered system.

Therefore, with respect to railway, marine, transport vehicles, agricultural vehicles, or off-highway vehicle applications this may refer to the movement of the system from a present location to a destination. In the case of stationary applications, such as but not limited to a stationary power generating station or network of power generating stations, a specified mission may refer to an amount of wattage (e.g., MW/hr) or other parameter or requirement to be satisfied by the diesel powered system. Likewise, operating conditions of the diesel-fueled power generating unit may include one or more of speed, load, fueling value, timing, etc. Furthermore, though diesel powered systems are disclosed, those skilled in the art will readily recognize that embodiments of the invention may also be utilized with non-diesel powered systems, such as but not limited to natural gas powered systems, biodiesel powered systems, etc.

Furthermore, as disclosed herein such non-diesel powered systems, as well as diesel powered systems, may include multiple engines, other power sources, and/or additional power sources, such as, but not limited to, battery sources, voltage sources (such as but not limited to capacitors), chemical sources, pressure based sources (such as but not limited to spring and/or hydraulic expansion), current sources (such as but not limited to inductors), inertial sources (such as but not limited to flywheel devices), gravitational-based power sources, and/or thermal-based power sources.

In one exemplary example involving marine vessels, a plurality of tugs may be operating together where all are moving the same larger vessel, where each tug is linked in time to accomplish the mission of moving the larger vessel. In another exemplary example a single marine vessel may have a plurality of engines. Off-Highway Vehicle (OHV) applications may involve a fleet of vehicles that have a same mission to move earth, from location A to location B, where each OHV is linked in time to accomplish the mission. With respect to a stationary power generating station, a plurality of stations may be grouped together for collectively generating power for a specific location and/or purpose. In another exemplary embodiment, a single station is provided, but with a plurality of generators making up the single station. In one exemplary example involving locomotive vehicles, a plurality of diesel powered systems may be operated together where all are moving the same larger load, where each system is linked in time to accomplish the mission of moving the larger load. In another exemplary embodiment a locomotive vehicle may have more than one diesel powered system.

Figure 20:
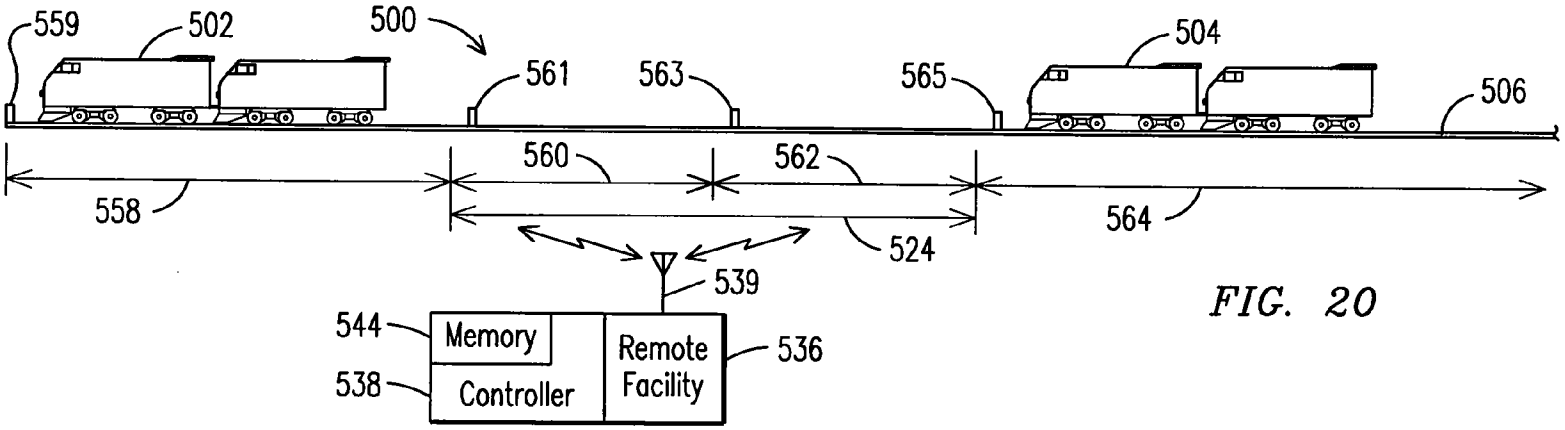
FIG. 20 illustrates an exemplary embodiment of a system for pacing a pair of locomotives traveling along a route according to the present invention.
Figure 24:
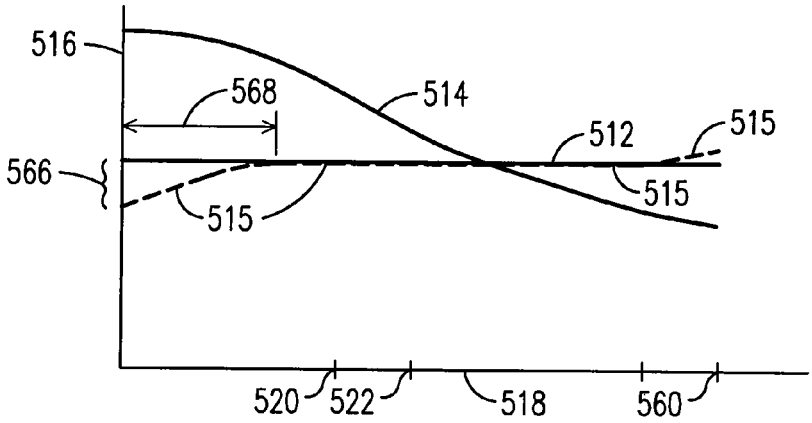
FIG. 24 illustrates an exemplary plot of a respective velocity plan versus the traveled distance along the route of the pair of locomotives based on the respective distance plan plot of FIG. 23.

FIG. 20 illustrates an exemplary embodiment of a system 500 for pacing a plurality of powered systems, such as a pair of locomotives 502,504, for example, traveling along a route 506. The pair of locomotives 502,504 include a constraining locomotive 502 and a trailing locomotive 504 traveling behind the constraining locomotive 502 along the route 506. (By "constraining," it is meant that because the constraining locomotive is ahead of the trailing locomotive along the route 506, movement of the trailing locomotive along the route 506 may be limited by (i.e., constrained by) the constraining locomotive, it being assumed that the locomotives travel in sequence because only one track is available.) In an exemplary embodiment, the pair of locomotives 502,504 travel along a route 506, such as a railroad track, for example. Although FIG. 20 illustrates a single trailing locomotive 504, more than one trailing locomotive may be present. The plurality of locomotives 502,504 each include a respective controller 508,510 (FIG. 21) configured to predetermine a respective velocity plan 512,514 (FIG. 24) of an operating parameter 516 of the locomotives 502,504 at incremental locations 520,522 along the route 506. For example, in the exemplary plot of FIG. 24, the operating parameter 516 may be the velocity of the respective constraining locomotive 502 and the trailing locomotive 504 based on the distance traveled 518 along the route. In addition to predetermining the respective velocity plan 512,514, the respective controller 508,510 is further configured to enforce the respective velocity plan 512,514 at the incremental locations 520,522 along the route 506. Although the incremental locations 520,522 in the exemplary plot of FIG. 24 are specific locations along the route 506, the respective controller 508,510 is configured to enforce the respective velocity plan 512,514 throughout a trip, including at incremental locations prior to and subsequent to the incremental locations 520,522 illustrated in FIG. 24. Additionally, the incremental locations 520,522 have no preset proximity. In an exemplary embodiment, their separation may vary (from route-to-route and/or across a single route) based on several factors including but not limited to the length of the route 506, a characteristic of the locomotives 502,504, and/or the characteristics of the route 506 (eg. grade), for example.

As further illustrated in the exemplary embodiment of FIG. 24, in an exemplary embodiment of the present invention, the controller 510 of the trailing locomotive 504 is reconfigured to enforce a modified velocity plan 515 based on the predetermined velocity plan 512 of the constraining locomotive 502. Upon enforcing the modified velocity plan 515, the trailing locomotive 504 maintains at least a threshold separation 524 from the constraining locomotive 502 along the route 506. Further details regarding the modified velocity plan 515, and the threshold separation 524, are discussed in the exemplary embodiments below.

The determination of the respective velocity plan 512,514 (FIG. 24) is based upon a respective transit time 526,528 of the constraining locomotive and trailing locomotive over a fixed distance 530 along the route 506. As illustrated in the exemplary plot of FIG. 23, which illustrates the respective distance traveled versus time for the respective constraining locomotive 502 and the trailing locomotive 504, the transit time 526 of the constraining locomotive 502 to travel the fixed distance 530 is greater than the transit time 528 of the trailing locomotive 504 to travel the fixed distance 530. As illustrated in the exemplary embodiment of FIG. 21, the constraining locomotive 502 and the trailing locomotive 504 include a respective transceiver 509,511 coupled to the respective controller 508,510. The controllers 508,510 may thus communicate via their respective transceivers, or may communicate through a transceiver 539 of a remote facility 536 positioned remotely from the route 506, for example, as discussed below. The controller 510 of the trailing locomotive 504 is configured to receive the transit time 526 of the constraining locomotive 502 (via wireless communication of the transceiver 511 with the transceiver 509 of the constraining locomotive 502 and/or the transceiver 539 of the remote facility 536). The controller 510 is configured to identify the transit time 526 as the transit time of the constraining locomotive 502 (i.e., the slowest transit time of a leading locomotive), by comparing the transit time 526 with other received transit times (in an example of more than two locomotives pursuing the constraining locomotive 502). By receiving the transit time 526 of the constraining locomotive 502 across the fixed distance 530, the controller 510 of the trailing locomotive 504 may determine the modified velocity plan 515 based on the received transit time 526 of the constraining locomotive 502. For example, the controller 510 of the trailing locomotive 504 may compute a predetermined velocity plan, by using the transit time 526 of the constraining locomotive 502 instead of using the transit time 528 of the trailing locomotive 504, for example. In addition to the transit time 526 of the constraining locomotive 502, the controller 510 may determine the modified velocity plan 515 as it usually would, such as utilizing a characteristic of the trailing locomotive 504, such as a ratio of the horsepower per pound of weight, for example, in addition to a characteristic of the route 506 along the fixed distance 530, such as a grade, for example.

Figure 22:
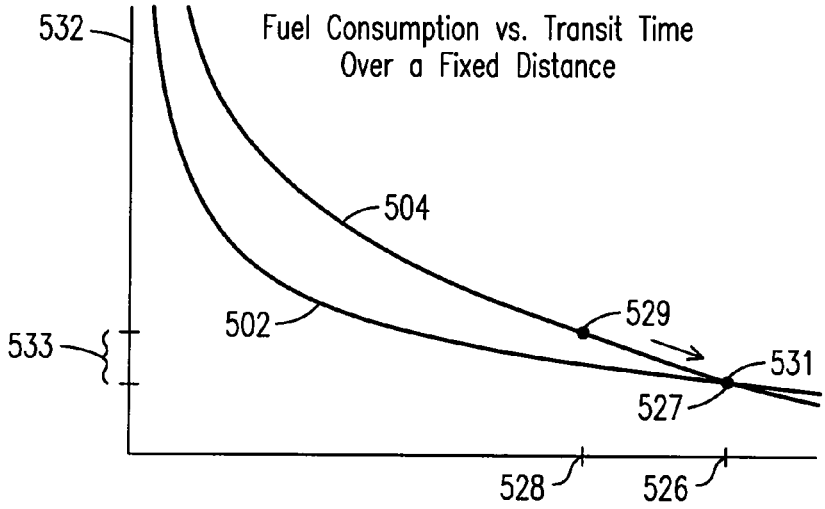
FIG. 22 illustrates an exemplary plot of an optimized performance characteristic versus a transit time of a pair of locomotives traveling a fixed distance along a route.

The controllers 508,510 of the constraining locomotive 502 and trailing locomotive 504 are configured to predetermine their respective velocity plan 512,514 based on optimizing a performance characteristic 532, such as minimizing a quantity of consumed fuel for traveling the fixed distance 530 along the route 506, for example. The exemplary embodiment of FIG. 22 illustrates an exemplary plot of the performance characteristic 532, such as the quantity of consumed fuel, versus the transit time of the respective constraining locomotive 502 and trailing locomotive 504 over the fixed distance 530 along the route 506. Each exemplary plot in FIG. 22 represents a plurality of predetermined plans of an operating parameter 516, calculated from traveling the fixed distance 530 along the route 506, where each plan is based on the transit time. As shown in FIG. 22, the controller 508 of the constraining locomotive 502 selected a distance plan 527 having a longer transit time 526, and the controller 510 of the trailing locomotive 504 initially selected a distance plan 529 having a shorter transit time 528 for traveling the fixed distance 530 over the route 506. Thus, the respective controller 508,510 initially selected a predetermined distance plan from among the plurality of predetermined plans based on the respected transit time 526,528. The controller 510 of the trailing locomotive 504 is reconfigured to select a distance plan 531 from among the plurality of predetermined plans having a longer transit time 526 that corresponds to the transit time 526 of the constraining locomotive 502. This reconfiguration of the controller 510 is illustrated by the arrow in FIG. 22, in which the controller 510 goes from selecting the distance plan 529 to distance plan 531. Coincidentally, the second selected distance plan 531 may enjoy a noticeable fuel saving 533 when compared to the first selected distance plan 529 by the controller 510 of the trailing locomotive 504.

Figure 23:
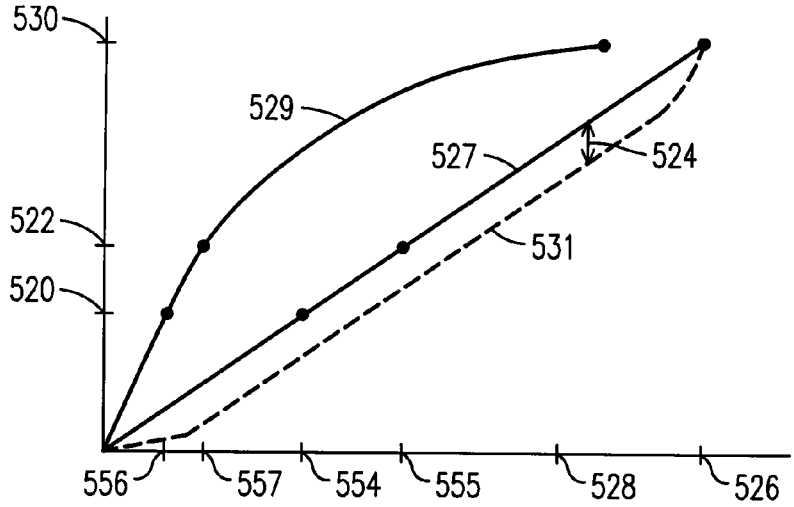
FIG. 23 illustrates an exemplary plot of a respective distance plan versus the transit time of the pair of locomotives based on the respective optimized performance plot of FIG. 22.

FIG. 23 illustrates an exemplary plot of the respective distance traveled under the selected distance plan 527 of the constraining locomotive 502 and the distance plans 529,531 of the trailing locomotive 504, versus the transit time. Unlike the first selected distance plan 529 of the trailing locomotive 504, which is consistently ahead of the constraining locomotive 502 throughout the route 506 along the fixed distance 530, the second selected distance plan 531 of the trailing locomotive 504 is consistently behind the constraining locomotive 502 by a threshold separation 524, as discussed below, throughout the route 506 along the fixed distance 530.

Figure 21:
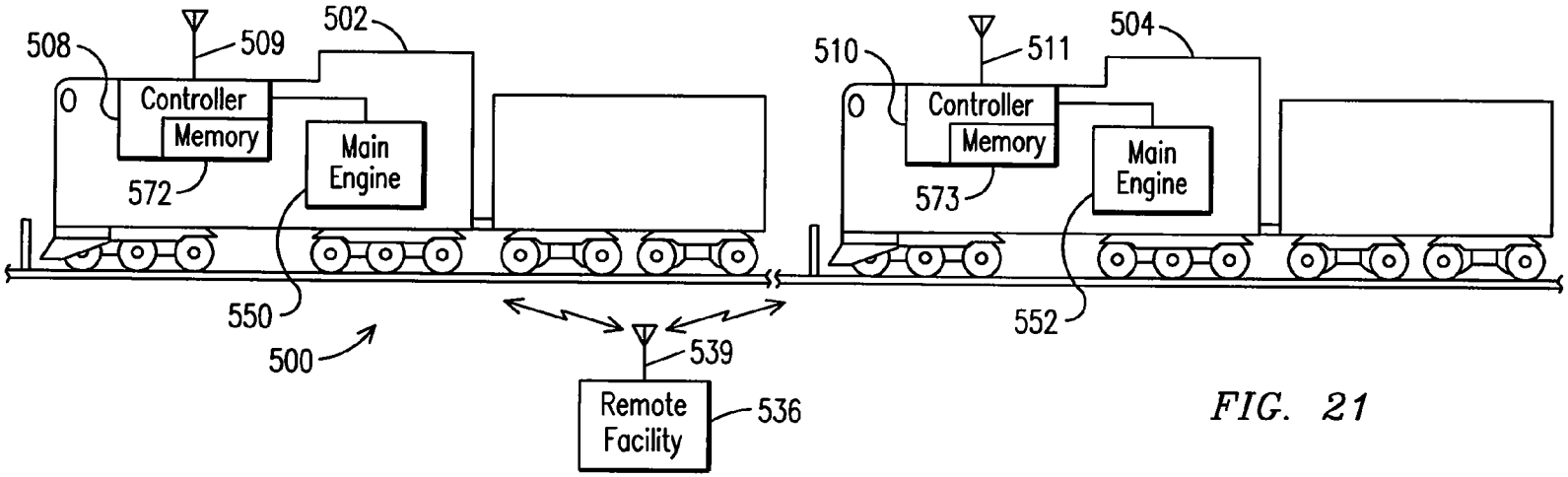
FIG. 21 illustrates an exemplary embodiment of the system for pacing a pair of locomotives traveling along the route illustrated in FIG. 20.

As illustrated in FIG. 21, and discussed above, the remote facility 536 includes a transceiver 539 to communicate with the respective transceiver 509,511 coupled to the respective controller 508,510 of the constraining locomotive 502 and trailing locomotive 504. The respective controller 508,510 may be configured to communicate the respective transit time 526,528 of the constraining locomotive 502 and trailing locomotive 504 to the remote facility 536. The remote facility 536 includes a controller 538 configured to identify the constraining locomotive 502 based upon the transit time 526 of the constraining locomotive 502 being greater than the transit time 528 of the trailing locomotive 504. The controller 538 is configured to communicate the transit time 526 of the constraining locomotive 502 to the controller 510 of the trailing locomotive 504, such that the controller 510 may determine the modified velocity plan 515, as discussed above.

Additionally, the controllers 508,510 of the constraining locomotive 502 and trailing locomotive 504 may determine the respective velocity plan 512,514 based on a respective characteristic of the constraining locomotive 502 and trailing locomotive 504, such as a rating of the horsepower to the weight of the locomotive, for example. In an exemplary embodiment, the controller 510 of the trailing locomotive 504 is configured to communicate with the controller 508 of the constraining locomotive 502 (through the respective transceivers 509,511) to receive the characteristic of the constraining locomotive 502. Upon receiving the characteristic of the constraining locomotive 502, the controller 510 may be reconfigured to determine the modified velocity plan 515 based upon the received characteristic of the constraining locomotive 502. Thus, in an exemplary embodiment, the controller 510 may substitute the characteristic of the constraining locomotive 502 for the characteristic of the trailing locomotive 504, and determine the modified velocity plan 515 as it would its own predetermined velocity plan, for example.

The controllers 508,510 are configured to communicate (via respective transceivers 509,511) the respective characteristics of the constraining locomotive 502 and trailing locomotive 504 to the transceiver 539 of the remote facility 536. The remote facility 536 includes a controller 538, which is configured to assign one of a plurality of indexed velocity plans 512,514 to the constraining locomotive 502 and the trailing locomotive 504. The plurality of indexed velocity plans 512,514 are stored in a memory 544 of the controller 538 and are itemized based on the received characteristic of the constraining locomotive 502 and the trailing locomotive 504. The remote facility controller 538 is configured to transmit the indexed velocity plan 512 based on the constraining locomotive 502 characteristic to the respective controller 508, 510 of the constraining locomotive 502 and the trailing locomotive 504. The respective controller 508,510 of the constraining locomotive 502 and the trailing locomotive 504 are configured to enforce the indexed velocity plan 512 of the constraining locomotive 502. In an exemplary embodiment, as illustrated in FIG. 24, and as discussed below, the controller 510 of the trailing locomotive 504 is reconfigured to modify the indexed velocity plan 512 into the modified velocity plan 515, based on introducing an initial delay 566 along an initial distance 568, so to maintain a threshold separation 524 between the constraining locomotive 502 and the trailing locomotive 504 throughout the fixed distance 530 along the route 506. In an exemplary embodiment, the characteristic of the constraining locomotive 502 and the trailing locomotive 504 is a ratio of a power of a main engine 550,552 to the weight of the locomotive 502,504. The remote facility controller 538 is configured to identify the constraining locomotive 502 and is configured to index a velocity plan 512 to the constraining locomotive 502 based on the ratio of the constraining locomotive 502 being lower than the ratio of the trailing locomotive 504. For example, the characteristic of the constraining locomotive 502 may be 2 horsepower per ton while the characteristic of the trailing locomotive 504 may be 5 horsepower per ton.

Additionally, as discussed above, the respective controllers 508,510 may be in communication via their respective transceivers 509,511, and the controller 510 of the trailing locomotive 504 is configured to receive the respective characteristic from the controller 508 of the trailing locomotive 502, including the respective characteristic from all controllers of all locomotives (in the event that more than two locomotives are utilized). If more than two locomotives are utilized, the controller 510 is further configured to identify the characteristic of the constraining locomotive 502 from the respective characteristics of the plurality of locomotives. In an example in which the characteristic of the locomotives was represented in horsepower per ton, the controller 510 is configured to identify the characteristic of the constraining locomotive 502, as having a ratio lower than the ratios from the other locomotives. Of course, the controller 510 can only conclude that a locomotive is a constraining locomotive 502 if it is positioned ahead of the trailing locomotive 504 on the route 506.

In addition to the transit times 526,528 and the characteristics of the respective constraining locomotive 502 and the trailing locomotive 504, the respective velocity plans 512,514 may be determined by the respective controllers 508,510 on the basis of respective arrival times (554,555)(556,557) of the respective locomotive 502,504 at incremental locations 520, 522 along the route 506 (FIG. 23). The respective arrival times (554,555) of the constraining locomotive 502 at the incremental locations 520,522 is later than the respective arrival times (556,557) of the trailing locomotive 504 at the incremental locations 520,522. The controller 510 of the trailing locomotive 504 is configured to receive the respective arrival times (554,555) of the constraining locomotive 502 (via the transceivers 509,511) from the controller 508. The controller 510 is reconfigured to determine the modified velocity plan 515 based upon the received respective arrival times (554,555) of the constraining locomotive 502 at the incremental locations 520,522. As illustrated in FIG. 23, the exemplary plot of the modified distance plan 531 demonstrates that the trailing locomotive 504 is no longer scheduled to arrive at the incremental locations 520,522 ahead of the constraining locomotive 502.

As illustrated in the exemplary embodiment of FIG. 20, the route 506 is separated into a plurality of block regions 558, 560,562,564, in which each block region includes a respective light signal 559,561,563,565. As appreciated by one of skill in the art, the light signal in a block region immediately preceding an occupied block region is red, indicating that a locomotive in that block region should stop. Additionally, the light signal in a second preceding block region to an occupied block region is yellow, indicating that a locomotive in that block region should slow down. Additionally, the light signal in a third preceding block region to an occupied block region is green, indicating that a locomotive in that block region is only subject to any speed limits in that block region. Thus, in order to achieve a "constant green" signal status, the trailing locomotive 504 needs to maintain a threshold separation 524 greater than or equal to the collective length of the two longest consecutive block regions 560,562 along the route 506. Note that FIG. 20 is not drawn to scale, in order to fit the constraining locomotive 502 within the block region 558 and to fit the trailing locomotive 504 within the block region 564. The controller 510 of trailing locomotive 504 is configured to determine the modified velocity plan 515 by introducing the initial delay 566 in the predetermined velocity plan 515 of the constraining locomotive 502 during the initial distance 568 along the route 506. The initial delay 566 in the velocities of the modified velocity plan 515 is selected such that the threshold separation 524 is at least equal to the collective length of the two longest consecutive block regions 560,562 along the route. As illustrated in the exemplary plot of FIG. 24, for the remainder of the modified velocity plan 515 subsequent to the initial distance 568, the modified velocity plan 515 is substantially similar to the predetermined velocity plan 512 of the constraining locomotive 502. Also as illustrated in the exemplary embodiment of FIG. 24, the modified velocity plan 515 may include slightly larger velocities than the predetermined velocity plan 512 toward the end of the fixed distance 560, such that the trailing locomotive 504 arrives at the fixed distance 560 at the same transit time 526, for example.

In an exemplary embodiment, the respective controllers 508,510 of the constraining locomotive 502 and trailing locomotive 504 may include a respective memory 572,573 having a stored length of the plurality of block regions 558,560,562, 564 along the route 506. The controller 510 of the trailing locomotive 504 is configured to retrieve the stored length data of the two longest consecutive block regions 560,562 along the route 506 upon introducing the initial delay 566 in the predetermined velocity plan 512 of the constraining locomotive 502.

In an exemplary embodiment, the remote facility controller 538 is configured to receive a characteristic of the constraining locomotive 502 and the trailing locomotive 504 from the controllers 508,510 (via the transceivers 509,511 to the transceiver 539). The remote facility controller 538 is configured to determine the modified velocity plan 515 of the constraining locomotive 502 by introducing the initial delay 566 in the predetermined velocity plan 512 of the constraining locomotive 502 during the initial distance 568 along the route 506 such that the threshold distance 524 is at least equal to the collective length of the two longest consecutive block regions 560,562 along the route 506.

Figure 25:
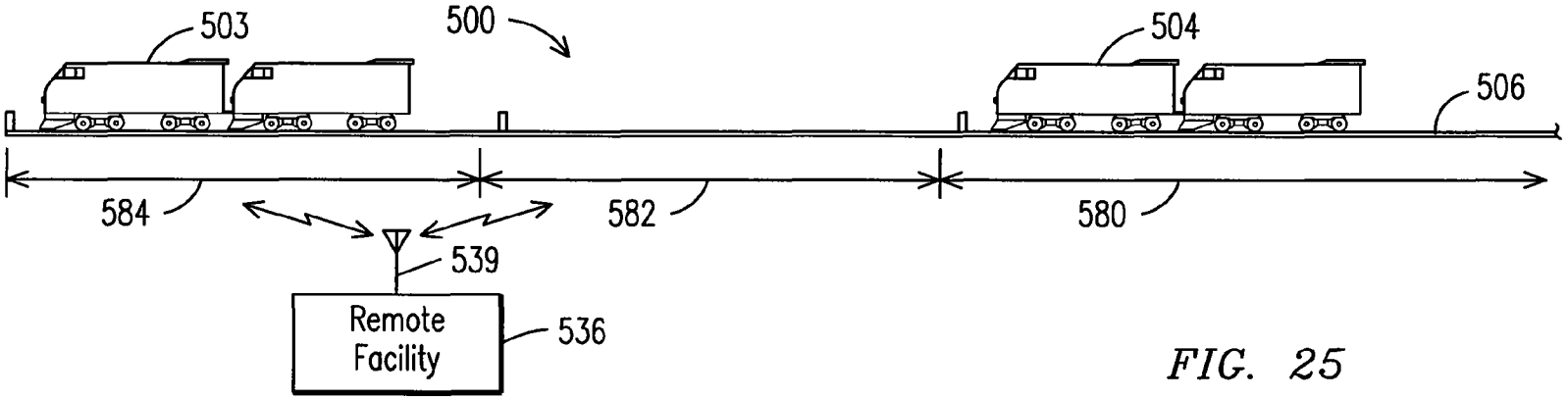
FIG. 25 illustrates an exemplary embodiment of a system for pacing a pair of locomotives traveling along a route according to the present invention.

FIG. 25 illustrates an exemplary embodiment of a scenario in which the trailing locomotive 504 has traveled to a subsequent block region 580, and a locomotive 503 enters onto the route 506 between the constraining locomotive 502 and the trailing locomotive 504. Thus, the locomotive 503 thus becomes an effective "new constraining locomotive" 503. The respective controllers of the new constraining locomotive 503 and the constraining locomotive 502 communicate with one another and the remote facility 536 in the same manner as discussed in the above embodiments so that a modified velocity plan, based on the velocity plan of the locomotive 503, can be devised to be enforced by the controller of the trailing locomotive 504. Since the new constraining locomotive 503 entered the route 506 with only a single block 582 separation from the trailing locomotive 504, the modified velocity plan would need to include an initial reduced velocity of the trailing locomotive 504, such that the threshold separation 524 of at least the collective length of the two longest consecutive block regions along the route 506. In the event that block regions 582,584 are the two longest consecutive block regions along the route 506, the modified velocity plan would require an initial reduced velocity such that this threshold separation 524 can be established and maintained throughout the route 506.

Figure 26:
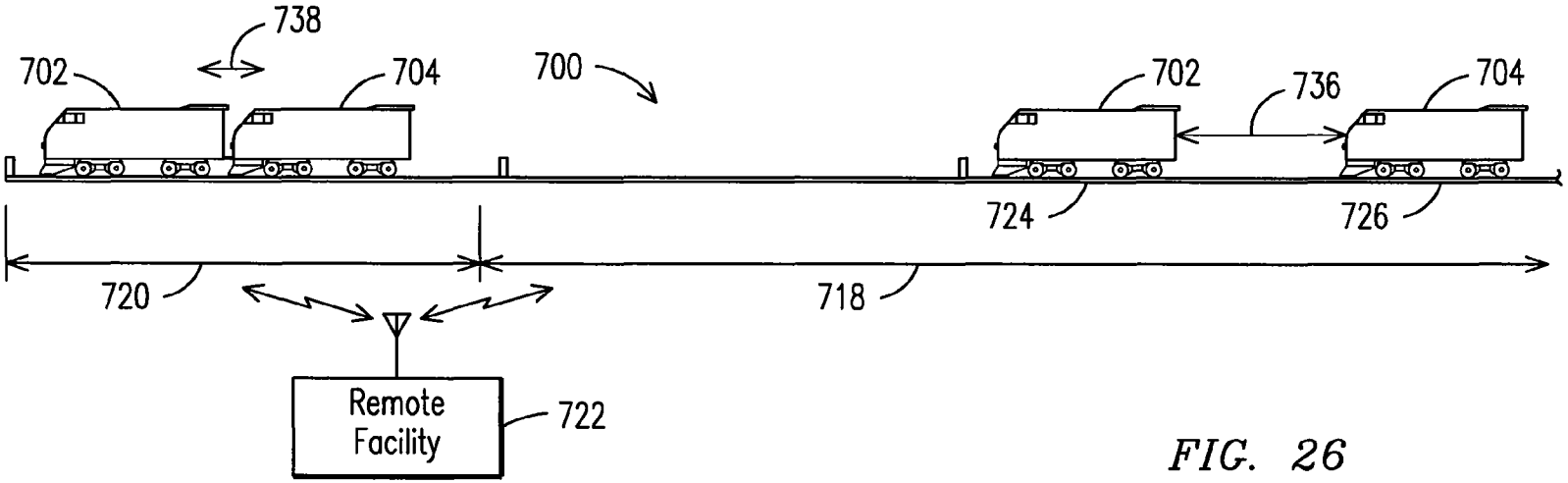
FIG. 26 illustrates an exemplary embodiment of a system for pacing a pair of locomotives traveling along a route in accordance with the present invention.
Figure 27:
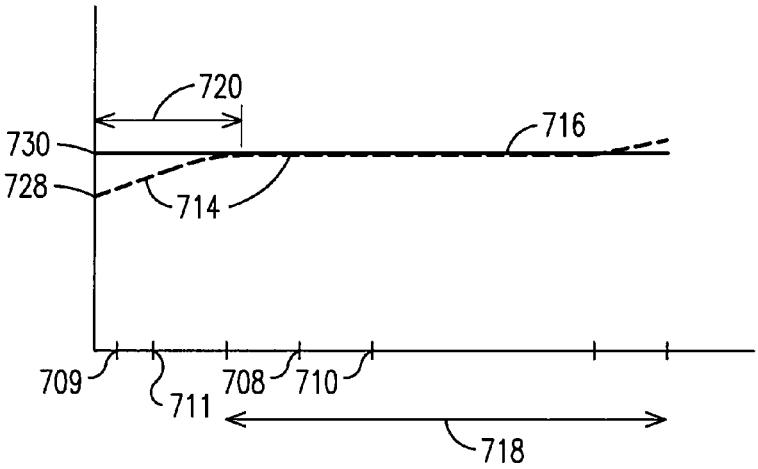
FIG. 27 illustrates an exemplary plot of a respective velocity of the pair of locomotives illustrated in FIG. 26 along the route.

FIG. 26 illustrates an exemplary embodiment of a system 700 for pacing a plurality of powered systems, such as a pair of locomotives 702,704, for example, traveling along a route 706. The pair of locomotives 702,704 are configured to travel along the route 706 with a common operating parameter, such as a common velocity 714,716, for example, at a respective incremental location 708,710 over a pacing region 718 along the route 706. FIG. 27 illustrates an exemplary plot of the respective velocities of the pair of locomotives 702,704 along the route 706, including the pacing region 718, for example. Over the pacing region 718, the common velocity 714,716 of the respective locomotives 702,704 is provided such that the pair of locomotives 702,704 maintain a minimum spacing variation and/or a minimum velocity variation over the pacing region 718. For example, as illustrated in the exemplary embodiment of FIG. 26, the spacing 738 of the pair of locomotives 702,704 in the pacing region 718 does not vary beyond a predetermined threshold, most notably due to the respective velocity 714,716 of the pair of locomotives 702, 704 being substantially similar in the pacing region 718 (FIG. 27).

Additionally, a pre-pacing region 720 is positioned prior to the pacing region 718, and the pair of locomotives 702,704 are configured to travel along the route 706 with a respective velocity 714,716 at respective incremental locations the pair of locomotives 702,704 at the respective incremental locations 709,711, the pair of locomotives 702,704 establish the minimum spacing variation and/or the minimum velocity variation upon entering the pacing region 718. For example, FIG. 27 illustrates a reduced velocity 714 of the first locomotive 702 in the pre-pacing region 720, relative to the higher velocity 716 of the second locomotive 704 in the pre-pacing region 720. Additionally, FIG. 26 illustrates an initial spacing 736 between the first and second locomotive 702,704, which may exceed a desired final separation 738 in the pacing region 718. Thus, by reducing the respective velocity 714 of the first locomotive 702 in the pre-pacing region 720, the first locomotive 702 will effectively "slow down" relative to the second locomotive 704, and the second locomotive 704 will effectively "catch up" to the first locomotive 702, resulting in a reduction in the initial spacing 736 upon entering the pacing region 718. Additionally, as illustrated in FIG. 27, the respective velocities 714,716 of the first and second locomotives 702,704 are substantially equal upon entering the pacing region 718, which accounts for the minimum spacing variation and/or minimum velocity variation between the locomotives 702,704 remaining intact. Although FIGS. 26-27 illustrate a pair of locomotives 702,704, more than two locomotives may be employed in the system 700, in which the relative separation between each respective adjacent pair of locomotives is adjusted to a desired spacing in the pre-pacing region, by adjusting the velocity of one or more locomotives in the pre-pacing region, while ensuring that the respective velocities of the locomotives are substantially similar in the pacing region, to maintain a minimal spacing variation and/or minimal velocity variation.

FIG. 27 further illustrates that an exemplary embodiment of the system 700 may include a remote facility 722 positioned remotely from the route 706. The remote facility 722 is in communication with the pair of locomotives 702,704, and is configured to determine the respective velocity 714,716 of the pair of locomotives 702,704 in the pre-pacing region 720, and in the pacing region 718. The determination of the respective velocity 714,716 of the pair of locomotives 702,704 is based on a respective parameter of the pair of locomotives 702,704 which is communicated to the remote facility 722 (via a transceiver on the locomotives 702,704), such as the initial position 724,726, the initial velocity 728,730, and/or a characteristic of the locomotives 702,704, for example.

By establishing the minimum separation variation and/or the minimum velocity variation in the pre-pacing region 720, and maintaining the minimum separation variation and/or the minimum velocity variation in the pacing region 718, various operational advantages may be recognized. For example, a total amount of consumed fuel of the pair of locomotives 702,704 may be minimized based on the pair of locomotives 702,704 having maintained the minimum velocity variation over the pacing region 718. In such an example, a number of instances in which a large notch setting of a main engine and a braking system of the locomotives 702,704 is used would be minimized, thus maximizing a fuel efficiency of the locomotives 702,704. In another example, the pair of locomotives 702,704 may be collectively accelerated to simultaneously vary a respective velocity 714,716 of the pair of locomotives 702,704, as the pair of locomotives 702,704 may maintain the minimum velocity variation and/or minimum spacing variation in such a scenario. In another example, the pre-pacing region 720 may precede a train yard, while the pacing region 718 may be a train yard. The respective velocities 714,716 of the pair of locomotives 702,704 at the incremental locations 708,710 in the pre-pacing region 720 are configured to establish the minimum separation variation upon the pair of locomotives 702,704 entering the yard. In another example, the plurality of powered systems may be a plurality of commuter trains, and the initial spacing in the pre-pacing region may exceed a minimum spacing variation based on an arrival time of one or more commuter trains in the pre-pacing region varying from a scheduled arrival time. For example, if commuter trains #1, 2 and 3 are scheduled to arrive at an incremental location in the pre-pacing region at noon, 1 pm and 2 pm, respectively, but commuter train #2 does not arrive until 2 pm, this may cause a large spacing between commuter train #1 and 2, and a small spacing between commuter train #2 and 3, which collectively exceeds a minimum spacing variation, for example. Thus, the respective velocities of the commuter trains #1,2,3 may involve a reduced velocity of commuter train #1 relative to commuter trains #2,3 (or an increased velocity of commuter trains #2,3 relative to commuter train #1), such that the spacing variation based on the spacing of commuter train #1 and 2, and the spacing of commuter train #2 and 3 is less than the minimum spacing variation upon entering the pacing region.

Figure 28:
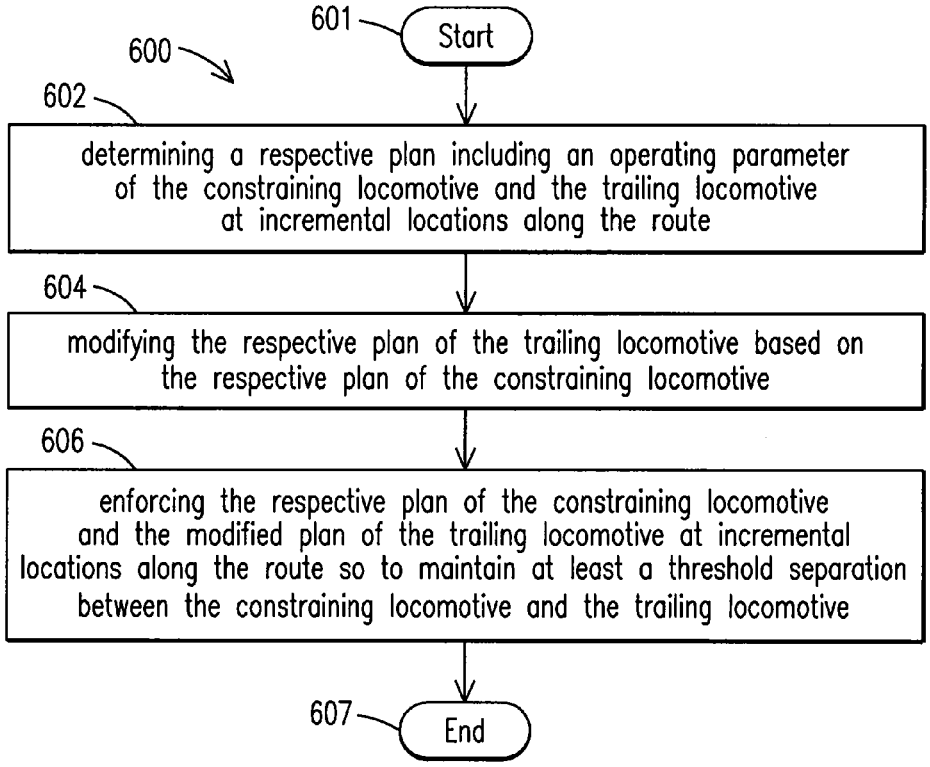
FIG. 28 illustrates a flow chart of an exemplary embodiment of a method for pacing a pair of locomotives traveling along a route according to the present invention.

FIG. 28 illustrates an exemplary embodiment of a method 600 for pacing a plurality of powered systems, such as a pair of locomotives 502,504 traveling along a route 506. The pair of locomotives 502,504 include a constraining locomotive 502 and a trailing locomotive 504 traveling behind the constraining locomotive 502 along the route 506. The method 600 begins at 601 by determining 602 a respective velocity plan 512,514 including an operating parameter 516 of the constraining locomotive 502 and the trailing locomotive 504 at incremental locations 520,522 along the route 506. The method 600 further includes modifying 604 the respective velocity plan 514 of the trailing locomotive 504 based on the respective velocity plan of the constraining locomotive 502. The method 600 further includes enforcing 606 the respective velocity plan 512 of the constraining locomotive 502 and the modified velocity plan 515 of the trailing locomotive 504 at incremental locations 520,522 along the route 506 so to maintain at least a threshold separation 524 between the constraining locomotive 502 and the trailing locomotive 504, before ending at 607.

Figure 29:
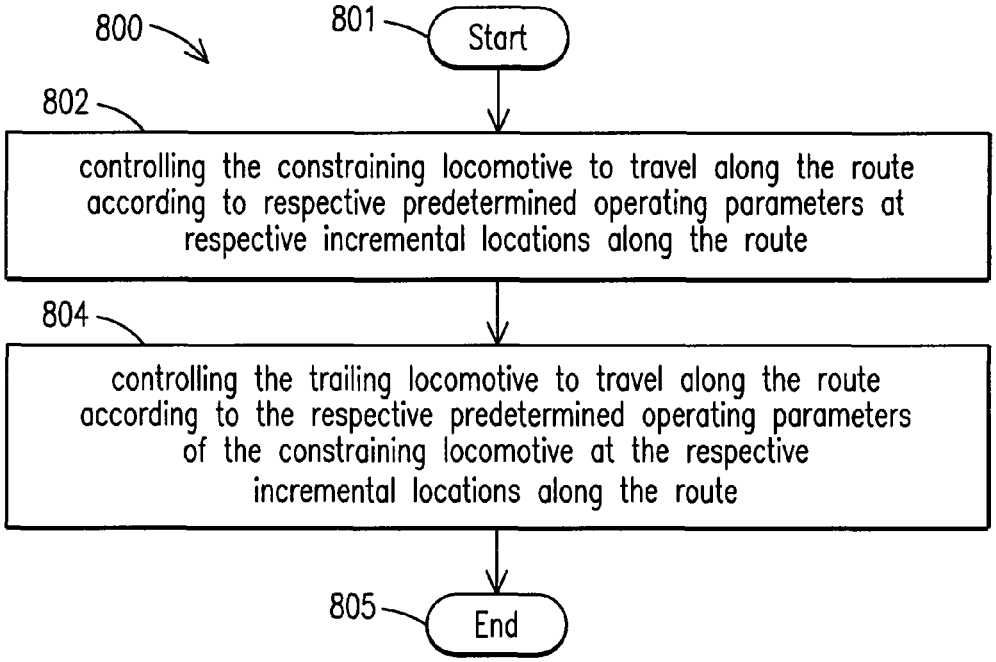
FIG. 29 illustrates a flow chart of an exemplary embodiment of a method for pacing a pair of locomotives traveling along a route according to the present invention.

FIG. 29 illustrates an exemplary embodiment of a method 800 for pacing a plurality of powered systems, such as a pair of locomotives 502,504 traveling along a route 506. The pair of locomotives 502,504 include a constraining locomotive 502 and a trailing locomotive 504 traveling behind the constraining locomotive 502 along the route 506. The method 800 begins at 801 by controlling 802 the constraining locomotive 502 to travel along the route 506 according to respective predetermined operating parameters 512 at respective incremental locations 520,522 along the route 506. The method 800 further includes controlling 804 the trailing locomotive 504 to travel along the route 506 according to the respective predetermined operating parameters 512 of the constraining locomotive 502 at the respective incremental locations 520,522 along the route 506, before ending at 805.

While the present invention has been described with reference to various exemplary embodiments, it will be understood by those skilled in the art that various changes, omissions and/or additions may be made and equivalents may be substituted for elements thereof without departing from the spirit and scope of the invention. Other objective applications for the invention include but are not limited to: spacing of trains for arrival to a yard, recovering off-schedule commuter operations with evenly spaced trains, or as an efficient method to simultaneously slow, or speed up many trains in an overall railway operation, for example. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A system comprising:

a constraining controller configured to control a constraining powered system of a plurality of powered systems that also includes at least one trailing powered system traveling behind the constraining powered system along a route, the constraining controller configured to control the constraining powered system to travel along the route according to predetermined operating parameters at incremental locations along the route; and a trailing controller configured to control the trailing powered system to travel along the route according to the predetermined operating parameters of the constraining powered system at the incremental locations along the route;

wherein the constraining controller is configured to predetermine an operating plan that includes the predetermined operating parameters of the constraining powered system at the incremental locations along the route, the constraining controller further configured to enforce the operating plan at the incremental locations along the route;

wherein the trailing controller of the trailing powered system is configured to receive a transit time of the constraining powered system over a designated distance along the route, to determine a modified operating plan that is based on the transit time of the constraining powered system and the operating plan of the constraining powered system when the constraining powered system is traveling at a slower speed than the trailing powered system such that the transit time of the constraining powered system over the designated distance is longer than a transit time of the trailing powered system over the designated distance, and to enforce the modified plan enforced in order to cause the trailing powered system to maintain at least a threshold separation from the constraining powered system along the route;

wherein the constraining controller of the constraining powered system is configured to predetermine the operating plan based on increasing or decreasing a performance characteristic of the constraining powered system along the route; the constraining controller configured to determine a plurality of predetermined plans based on traveling the designated distance along the route, and is configured to a select the operating plan from among the plurality of predetermined plans based on the transit time; and wherein the trailing controller is configured to select the modified operating plan from among the plurality of predetermined plans based on the transit time of the constraining powered system.

2. A system comprising:

a constraining controller configured to control a constraining powered system of a plurality of powered systems that also includes at least one trailing powered system traveling behind the constraining powered system along a route, the constraining controller configured to control the constraining powered system to travel along the route according to predetermined operating parameters at incremental locations along the route; and a trailing controller configured to control the trailing powered system to travel along the route according to the predetermined operating parameters of the constraining powered system at the incremental locations along the route;

wherein the constraining controller is configured to predetermine an operating plan that includes the predetermined operating parameters of the constraining powered system at the incremental locations along the route, the constraining controller further configured to enforce the operating plan at the incremental locations along the route;

wherein the trailing controller of the trailing powered system is configured to receive a transit time of the constraining powered system over a designated distance along the route from the constraining powered system, to determine a modified operating plan based on the transit time of the constraining powered system and the operating plan of the constraining powered system when the constraining powered system is traveling at a slower speed than the trailing powered system, and to enforce the modified operating plan such that the trailing powered system maintains at least a threshold separation from the constraining powered system along the route; and further including a remote facility positioned remotely to the route; the remote facility configured to be in communication with the constraining controller and the trailing controller; the constraining controller and the trailing controller configured to communicate the transit time of the constraining powered system and a transit time of the trailing powered system, respectively, to the remote facility; the remote facility including a remote controller configured to identify the constraining powered system based on the transit time of the constraining powered system when the transit time of the constraining powered system is longer than the transit time of the trailing powered system.

3. A system comprising:

a constraining controller configured to control a constraining powered system of a plurality of powered systems that also includes at least one trailing powered system traveling behind the constraining powered system along a route, the constraining controller configured to control the constraining powered system to travel along the route according to predetermined operating parameters at incremental locations along the route; and a trailing controller configured to control the trailing powered system to travel along the route according to the predetermined operating parameters of the constraining powered system at the incremental locations along the route;

wherein the constraining controller is configured to predetermine an operating plan that includes the predetermined operating parameters of the constraining powered system at the incremental locations along the route, the constraining controller further configured to enforce the operating plan at the incremental locations along the route;

wherein the trailing controller of the trailing powered system is configured to receive a transit time of the constraining powered system over a designated distance along the route, to determine a modified operating plan that is based on the transit time of the constraining powered system and the operating plan of the constraining powered system when the constraining powered system is traveling at a slower speed than the trailing powered system, and to enforce the modified operating plan such that the trailing powered system maintains at least a threshold separation from the constraining powered system along the route; and wherein the constraining controller and the trailing controller are configured to be in communication with each other, the trailing controller configured to receive the transit time of the constraining powered system from the constraining controller and to identify the transit time of the constraining powered system as being greater than the transit time of the trailing powered system when the constraining powered system is traveling at a slower speed than the trailing powered system.

4. A system comprising:

a constraining controller configured to control a constraining powered system of a plurality of powered systems that also include at least one trailing powered system traveling behind the constraining powered system along a route, the constraining controller configured to control the constraining powered system to travel along the route according to predetermined operating parameters at incremental locations along the route;

a trailing controller configured to control the trailing powered system to travel along the route according to the predetermined operating parameters of the constraining powered system at the incremental locations along the route;

wherein the constraining controller is configured to predetermine an operating plan that includes the predetermined operating parameters of the constraining powered system at the incremental locations along the route, the constraining controller further configured to enforce the operating plan at the incremental locations along the route;

wherein the trailing controller of the trailing powered system is configured to receive a characteristic of the constraining powered system, to determine a modified operating plan based on the characteristic and the operating plan of the constraining powered system, and to enforce the modified operating plan such that the trailing powered system maintains at least a threshold separation from the constraining powered system along the route, wherein the characteristic is a ratio of a power of an engine of the constraining powered system to a weight of the constraining powered system; and a remote facility positioned remotely from the route and configured to be in communication with the constraining controller and the trailing controller; the constraining controller configured to communicate the characteristic of the constraining powered system to the remote facility; the remote facility including a remote controller configured to assign and transmit a selected indexed plan of plural indexed plans to the plurality of powered systems based on the characteristic of the constraining powered system, the indexed plans being stored in a memory of the remote controller and itemized based on the characteristic of the constraining powered system;

wherein the remote controller is configured to identify the constraining powered system and to index at least one of the indexed plans to the constraining powered system based on the ratio of the constraining powered system being lower than a ratio of a power of an engine of the trailing powered system to a weight of the trailing powered system, and wherein at least one of the constraining controller or the trailing controller of the plurality of powered systems is configured to enforce the selected indexed plan of the constraining powered system.

5. The system of claim 4, wherein the constraining controller and the trailing controller of the plurality of powered systems are configured to be in communication, the trailing controller configured to receive the characteristic of the constraining powered system from the constraining controller, and the trailing controller is further configured to identify the characteristic of the constraining powered system from a characteristic of the plurality of powered systems.

6. A system comprising:

a constraining controller configured to control a constraining powered system of a plurality of powered systems that also includes at least one trailing powered system traveling behind the constraining powered system along a route, the constraining controller configured to control the constraining powered system to travel along the route according to predetermined operating parameters at incremental locations along the route; and a trailing controller configured to control the trailing powered system to travel along the route according to the predetermined operating parameters of the constraining powered system at the incremental locations along the route;

wherein the constraining controller is configured to predetermine an operating plan that includes the predetermined operating parameters of the constraining powered system at the incremental locations along the route, the constraining controller further configured to enforce the operating plan at the incremental locations along the route;

wherein the trailing controller of the trailing powered system is configured to receive a characteristic of the constraining powered system, to determine a modified operating plan that is based on the characteristic and the operating plan of the constraining powered system, and to enforce the modified operating plan such that the trailing powered system maintains at least a threshold separation from the constraining powered system along the route;

wherein the characteristic of the constraining powered system is a ratio of a power of an engine to a weight of the constraining powered system; the trailing controller of the trailing powered system further configured to identify the characteristic of the constraining powered system as having the ratio of the power to the weight of the constraining powered system that is lower than a ratio of a power of engines to weight of the plurality of powered systems.

7. The system of claim 6, wherein at least one of the constraining powered system or the trailing powered system is a marine vehicle, an off-highway vehicle, a transport vehicle, or a rail vehicle.

8. A system comprising:

a constraining controller configured to control a constraining powered system of a plurality of powered systems that also includes at least one trailing powered system traveling behind the constraining powered system along a route, the constraining controller configured to control the constraining powered system to travel along the route according to predetermined operating parameters at incremental locations along the route; and a trailing controller configured to control the trailing powered system to travel along the route according to the predetermined operating parameters of the constraining powered system at the incremental locations along the route;

wherein the constraining controller is configured to predetermine an operating plan that includes the predetermined operating parameters of the constraining powered system at the incremental locations along the route, the constraining controller further configured to enforce the operating plan at the incremental locations along the route;

wherein the trailing controller of the trailing powered system is configured to enforce a modified operating plan based on the operating plan of the constraining powered system such that the trailing powered system maintains at least a threshold separation from the constraining powered system along the route; and wherein the route is separated into a plurality of block regions; and the trailing controller of the trailing powered system is configured to determine the modified operating plan by introducing an initial delay in the modified operating plan of the trailing powered system during an initial distance along the route such that the threshold separation is at least equal to a collective length of two or more of the block regions that are consecutive and longer than one or more other block regions in the plurality of block regions along the route.

9. The system of claim 8, wherein the trailing controller of the trailing powered system includes a memory having a stored length of the plurality of block regions along the route; the trailing controller configured to retrieve the stored length of the plurality of block regions upon introducing the initial delay in the predetermined plan of the constraining powered system.

10. A system comprising:

a constraining controller configured to control a constraining powered system of a plurality of powered systems that also includes at least one trailing powered system traveling behind the constraining powered system along a route that is separated into a plurality of block regions, the constraining controller configured to control the constraining powered system to travel along the route according to predetermined operating parameters at incremental locations along the route; and a trailing controller configured to control the trailing powered system to travel along the route according to the predetermined operating parameters of the constraining powered system at the incremental locations along the route;

wherein the constraining controller is configured to predetermine an operating plan that includes the predetermined operating parameters of the constraining powered system at the incremental locations along the route, the constraining controller further configured to enforce the operating plan at the incremental locations along the route;

wherein the trailing controller of the trailing powered system is configured to enforce a modified operating plan based on the operating plan of the constraining powered system such that the trailing powered system maintains at least a threshold separation from the constraining powered system along the route; and a remote facility positioned remotely from the route and configured to be in communication with the constraining controller and the trailing controller of the plurality of powered systems; the remote facility including a remote controller that is configured to receive a first characteristic of the constraining powered system and a second characteristic of the trailing powered system; the remote controller being configured to determine the modified operating plan of the constraining powered system plan by introducing an initial delay in the modified operating plan of the trailing powered system during an initial distance along the route such that the threshold distance is at least equal to a collective length of two or more block regions of the plurality of block regions in the route that are longer than one or more other block regions along the route.

* * * * *

UNITED STATES PATENT AND TRADEMARK OFFICE

CERTIFICATE OF CORRECTION

PATENT NO. : 8,676,410 B2
APPLICATION NO. : 12/131616
DATED : March 18, 2014
INVENTOR(S) : Houpt et al.

It is certified that error appears in the above-identified patent and that said Letters Patent is hereby corrected as shown below:

In the Specification:

In Column 19, Line 7, delete "locomotive 31," and insert -- locomotive 42, --, therefor.

In Column 25, Line 52, delete "controller 214" and insert -- controller 226 --, therefor.

In the Claims:

In Column 38, Line 29, in Claim 1, delete "to a select" and insert -- to select --, therefor.

Signed and Sealed this
Seventeenth Day of June, 2014

Michelle K. Lee

Michelle K. Lee
*Deputy Director of the United States Patent and Trademark Office*